US011391105B2

(12) United States Patent
Switzer et al.

(10) Patent No.: US 11,391,105 B2
(45) Date of Patent: Jul. 19, 2022

(54) DOWNHOLE PULSE GENERATION

(71) Applicant: ALLIANCE OFS SOLUTIONS LLC, Conroe, TX (US)

(72) Inventors: David A. Switzer, Calgary (CA); Irina Alexina, Montgomery, TX (US)

(73) Assignee: QUANTUM ENERGY TECHNOLOGIES LLC, Houston, TX (US)

( * ) Notice: Subject to any disclaimer, the term of this patent is extended or adjusted under 35 U.S.C. 154(b) by 210 days.

(21) Appl. No.: 16/919,232

(22) Filed: Jul. 2, 2020

(65) Prior Publication Data

US 2022/0003063 A1 Jan. 6, 2022

(51) Int. Cl.
*E21B 31/00* (2006.01)
*E21B 47/00* (2012.01)

(52) U.S. Cl.
CPC ..... *E21B 31/005* (2013.01); *E21B 47/00* (2013.01)

(58) Field of Classification Search
CPC ..... E21B 31/005; E21B 47/00; E21B 47/18; E21B 28/00; E21B 47/14; E21B 7/24
See application file for complete search history.

(56) References Cited

U.S. PATENT DOCUMENTS 10,184,333 B2 1/2019 Gosney et al.
10,301,879 B2 5/2019 Hay
11,098,548 B2 * 8/2021 Samuel ..... E21B 7/046
2003/0201101 A1 * 10/2003 Kostrov ..... G01V 1/02 166/177.2
2017/0096869 A1 * 4/2017 Kostrov ..... E21B 43/003
2017/0191325 A1 * 7/2017 Campbell ..... E21B 4/02
2018/0355669 A1 * 12/2018 Shen ..... E21B 7/24
2019/0360320 A1 * 11/2019 Hohl ..... G01L 5/10
2022/0003063 A1 * 1/2022 Switzer ..... E21B 47/00

FOREIGN PATENT DOCUMENTS

BR 112015018339 B1 * 8/2021 ..... E21B 17/00
CN 106948760 A * 7/2017 ..... E21B 7/24
CN 110043191 A * 7/2019
WO WO-2011145979 A1 * 11/2011 ..... E21B 28/00

* cited by examiner

*Primary Examiner* — Daniel P Stephenson
(74) *Attorney, Agent, or Firm* — Basil M. Angelo; Angelo IP

(57) ABSTRACT

A method and system for downhole pulse generation determines an optimal frequency and, in some embodiments, amplitude of axial pressure pulses to maximize the rate of penetration. Specifically, one or more sensors may be disposed on or near an axial oscillation tool that provides near real-time raw sensor data relating to speed, velocity, and acceleration of the tool. With this sensor data, an optimal set of parameters, namely an optimal frequency and, in some embodiments, amplitude may be determined based on the hydraulic conditions and frictional forces of the actual drilling environment. An optimizing control system may directly communicate these parameters to the axial oscillation tool or pass the parameters to an axial oscillation tool control system that controls the operation of the tool. Advantageously, frictional forces may be substantially reduced, the rate of penetration may be substantially enhanced, and power consumption may be intelligently managed.

21 Claims, 13 Drawing Sheets

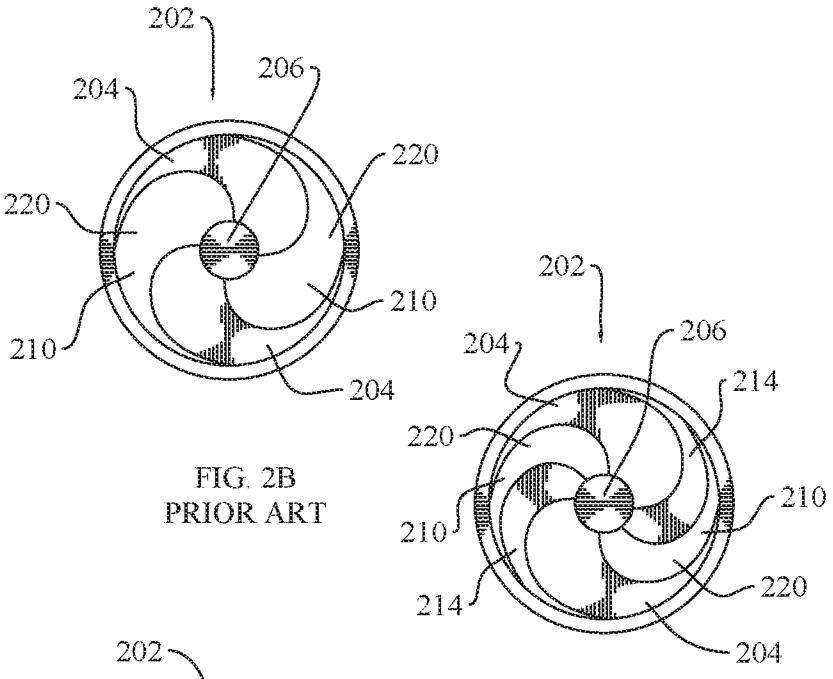
FIG. 2B
PRIOR ART
FIG. 2C
PRIOR ART
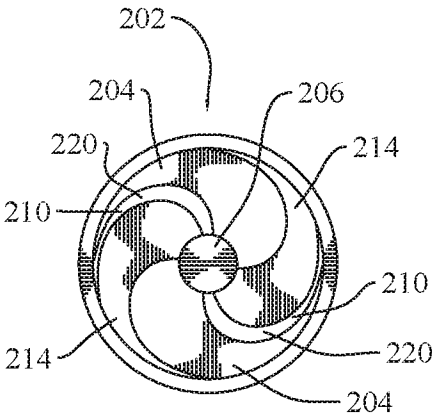
FIG. 2D
PRIOR ART
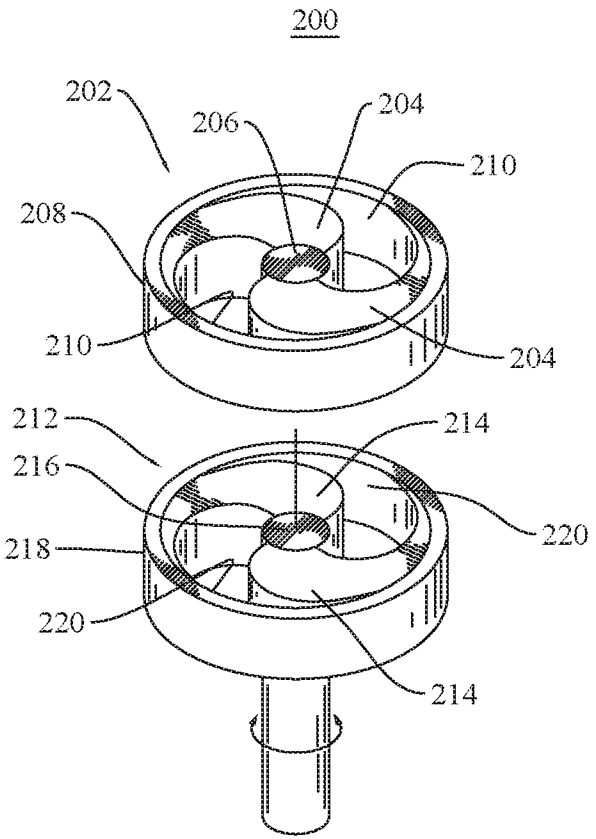
FIG. 2A
PRIOR ART

400

600

700

DOWNHOLE PULSE GENERATION

BACKGROUND OF THE INVENTION

The objective of conventional drilling operations is to drill a wellbore along a predetermined trajectory toward a target zone for the recovery of hydrocarbons disposed therein. The predetermined trajectory typically includes at least one vertical segment and may include one or more kickoff, build-up, tangential, or lateral sections. While the drilling rig is typically located as close as possible to the target zone, it may not be collocated when the trajectory calls for directional drilling and long lateral sections. While the type or kind of drilling rig may vary based on the application, the drilling rig includes different types of equipment required to perform drilling operations. The drilling rig often includes a top drive system that provides rotation to a drill string system that fluidly connects the drilling rig to a bottomhole assembly ("BHA") disposed on a distal end of the drill string. During drilling operations, drilling fluids are pumped from the surface through an interior passageway of the drill string system, out of the drill bit, and return through an annulus surrounding the drill string. The drilling fluids lubricate the drill bit, flush cuttings from the hole, and counterbalance the formation pressure. The returning fluids are typically processed and recycled on the drilling rig for reuse downhole. In this way, the drill string system communicates drilling fluid and torque to the drill bit.

The drill string system typically includes a plurality of drill pipe segments that fluidly connect the drilling rig to the BHA on the distal end of the drill string system disposed downhole. The BHA may include an axial oscillation tool, sometimes referred to as an agitator, a mud motor, and the drill bit on the distal end. However, in many applications, the axial oscillation tool is placed significantly further back from the drill bit to increase its effectiveness and in some applications more than one axial oscillation tool may be disposed along a length of the drill string system. As such, the one or more axial oscillation tools are used to reduce friction and force axial movement. During directional or slide drilling operations, rotation of the drill string stops and the mud motor is used to rotate the drill bit. The axial oscillation tool and the mud motor may be hydraulically powered by drilling fluids fluidly communicated down the interior passageway of the drill string system.

During drilling operations without rotation of the drill string, such as, for example, during directional or slide drilling in horizontal or near horizontal segments, the non-rotating drill string effectively slides as the wellbore is being drilled. When a portion of the drill string moves relative to the walls of the wellbore, there are dynamic frictional forces acting upon that interval of the drill string. However, if the portion of the drill string does not move relative to the walls of the wellbore, there are static frictional forces acting upon the interval. As such, when the drill string is rotating, there are typically only dynamic frictional forces acting on the system, however, when the drill string is sliding without rotation, the interval is dominated by static frictional forces. Because the coefficient of static frictional forces is higher than that of their dynamic counterpart, more weight is required to move or unstick the interval. Moreover, without smooth weight transfer to the drill bit, the elasticity of the drill string allows for a buildup of downward acting forces at a particular point or interval of the drill string rather than the drill bit where it is preferably placed. When the downward forces overcome the static frictional forces, there is a transfer of downward force transmitted further down the drill string system towards the drill bit. This causes spiking of applied force to the drill bit, which impairs the ability of the driller to control the drilling direction.

In directional drilling applications, a bent sub of the mud motor is typically coupled to the drill string system to enable drilling the desired direction. However, when weight is applied to the drill bit/rock interface, the tilt or toolface direction of the drill bit determines the direction drilled. The spike of applied force due to unsticking of the previously stuck interval can also result in an increase in the applied torque on the drill bit/rock interface which can cause reactive twisting of the drill string system including the bent sub. The spikes can also stall and potentially damage the mud motor. Further, the large angular oscillations can create damaging vibrations to equipment of the BHA. In certain applications, to prevent the spike of applied force resulting from unsticking the interval, the axial loading of the drill string system is varied using the axial oscillation tool in a cyclical manner. The axial loading causes periodic longitudinal movement or axial vibration of at least part of the drill string system thereby maintaining the drill string in a dynamic frictional mode.

BRIEF SUMMARY OF THE INVENTION

According to one aspect of one or more embodiments of the present invention, a method of downhole pulse generation includes commanding the axial oscillation tool to generate an axial pressure pulse or series of axial pressure pulses corresponding to a swept sinusoid having an initial amplitude, initial frequency, and frequency step size, measuring an output response corresponding to oscillation of the drill string system, determining a measured amplitude of the output response at each frequency step, calculating a ratio of measured amplitude to an initial amplitude at each frequency step constituting an unparameterized data set, parameterizing the data set to generate a transmissibility curve function, determining a dominant frequency from the transmissibility curve function, and commanding the axial oscillation tool to change the predetermined frequency to the dominant frequency.

According to one aspect of one or more embodiments of the present invention, a method of downhole pulse generation includes commanding an axial oscillation tool to generate an initial axial pressure pulse or series of axial pressure pulses having a predetermined amplitude and frequency down a drill string system, receiving raw sensor data from a sensor disposed on or near the axial oscillation tool, the raw sensor data comprising time-domain sensor output data, performing a Fast Fourier Transform of the raw sensor data to obtain frequency-domain sensor output data, determining a dominant frequency from the frequency-domain sensor output data, and commanding the axial oscillation tool to change the predetermined frequency to the dominant frequency.

According to one aspect of one or more embodiments of the present invention, a method of downhole pulse generation includes commanding an axial oscillation tool to generate an axial pressure pulse or a series of axial pressure pulses having an initial amplitude and frequency down a drill string system, measuring an output response corresponding to oscillation of the drill string system, determining a dominant frequency of the output response, commanding the axial oscillation tool to change the initial frequency to the dominant frequency, determining a downhole velocity for the initial amplitude, determining an optimal amplitude that maximizes downhole velocity, and commanding the axial oscillation tool to change the initial amplitude to the optimal amplitude.

According to one aspect of one or more embodiments of the present invention, a method of downhole pulse generation includes commanding an axial oscillation tool to generate an initial axial pressure pulse or a series of axial pressure pulses having an initial amplitude and frequency down a drill string system, determining a dominant frequency of an output response corresponding to oscillation of the drill string system, commanding the axial oscillation tool to change the initial frequency to the dominant frequency, determining an all directions speed for the initial amplitude, determining an optimal amplitude that maximizes the all directions speed, and commanding the axial oscillation tool to change the initial amplitude to the optimal amplitude.

Other aspects of the present invention will be apparent from the following description and claims.

BRIEF DESCRIPTION OF THE DRAWINGS

FIG. 2A shows a perspective view of a stator and rotor of an axial valve mechanism of a conventional axial oscillation tool.

FIG. 2B shows an aperture of the axial valve mechanism of a conventional axial oscillation tool with the stator and rotor aligned for maximum flow.

FIG. 2C shows an aperture of the axial valve mechanism of a conventional axial oscillation tool with the stator and rotor aligned for reduced flow.

FIG. 2D shows an aperture of the axial valve mechanism of a conventional axial oscillation tool with the stator and rotor aligned for further reduced flow.

DETAILED DESCRIPTION OF THE INVENTION

Figure 1B:
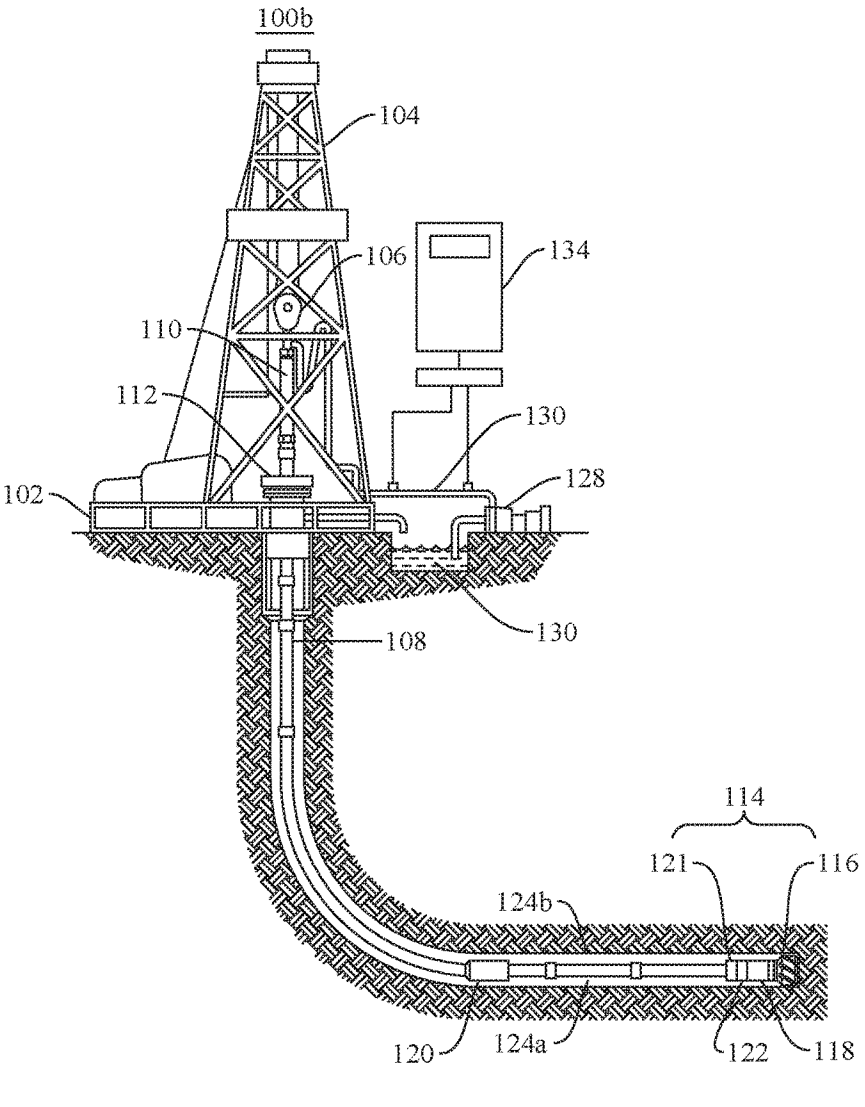
FIG. 1B PRIOR ART
FIG. 1B shows a conventional drilling rig drilling a lateral section of a wellbore with a conventional axial oscillation tool disposed downhole.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention. For the purposes of this disclosure, top, upper, or above refer to aspects closer to the surface and bottom, lower, and below refer to aspects closer to the bottom of the wellbore.

Figure 1A:
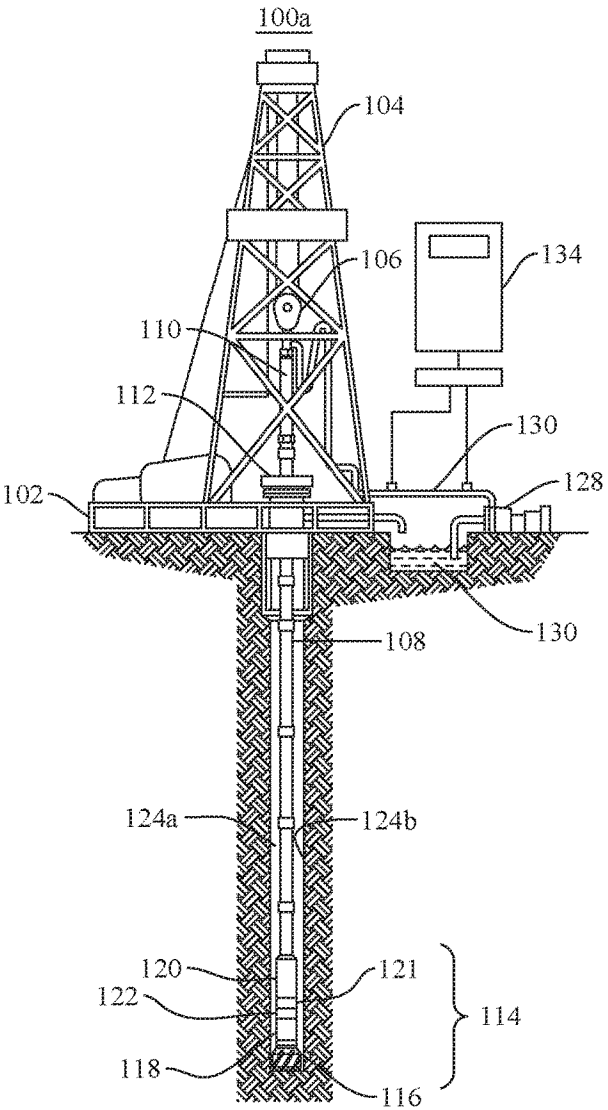
FIG. 1A PRIOR ART
FIG. 1A shows a conventional drilling rig drilling a straight section of a wellbore with a conventional axial oscillation tool disposed downhole.

FIG. 1A shows a conventional drilling rig 100*a* drilling a straight section of a wellbore 124*a* with a conventional axial oscillation tool 120 disposed downhole. While the drilling rig 100*a* depicted is merely exemplary, one of ordinary skill in the art, having the benefit of this disclosure, will appreciate that the type or kind of drilling rig, including the constituent equipment disposed thereon, may vary based on an application or design.

Drilling rig 100*a* may include a drilling platform 102, a derrick 104, a hoist 106, a top drive 110, and a wellhead 112. The derrick 104 may be disposed on the drilling platform 102 to support the hoist 106. The hoist 106 controls the position of the top drive 110 and the drill string system 108 attached thereto. The lower portion of the drill string system, sometimes referred to as the BHA 114, may include an axial oscillation tool 120, a telemetry package 121, an optional Measure While Drilling ("MWD") or Logging While Drilling ("LWD") package 122, a mud motor 118, and a drill bit 116. One or more mud pumps 128 may pump drilling fluids (not independently illustrated) from one or more mud tanks 130 down an interior passageway of the drill string 108. The drilling fluids may be fluidly communicated down the drill string system 108, exit the drill bit 116, and return to the surface in the annulus surrounding the drill string 108. The returning fluids may be processed by one or more fluids processing systems such as, for example, a mud-gas separator (not shown) or one or more shale shakers (not shown) prior to being returned to the mud tanks 130 for reuse downhole. During drilling operations, drill bit 116 rotates forming a wellbore 124*a* having wellbore wall 124*b*. The downhole mud motor 118 may be controlled by a rig-based control system 134 and the telemetry package 121. Typically, axial drag and frictional forces exist between drill string system 108 and wellbore wall 124*b*, which can slow down or even prevent drilling ahead. The axial oscillation tool 120 may be used to create axial pressure pulses down the drill string 108 that reduce the axial drag and frictional forces permitting axial movement of drill string system 108, potentially including the BHA 114, relative to wellbore walls 124*b*. Further, by reducing the axial drag and frictional forces, the ability to steer the BHA 114 may be significantly enhanced.

While the axial oscillation tool 120 is depicted as being disposed directly above the telemetry package 121 as part of the BHA 114, one of ordinary skill in the art will appreciate that the axial oscillation tool 120 may be placed in other locations along the drill string 108 and in some applications, where the trajectory is long, tortuous, or approaching horizontal, more than one axial oscillation tool 120 may be spaced out along the drill string system 108. Typically, the trajectory of the well path is studied in advance such that expected drag and frictional forces are calculated for at least those portions of the wellbore 124*a* of interest. Factors that may influence the calculation of such forces may include one or more of drill pipe weight per unit distance, drill pipe density per unit distance, tool joint shape, mud type, mud density, mud viscosity, expected cutting bed length, tortuosity of the wellbore 124*a*, inclination from vertical of the wellbore 124*a*, formation properties, type of drill bit 116, the profile of wellbore 124*a*, and anticipated differential sticking. In certain applications, models and simulations may be performed to determine the preferred location of one or more axial oscillation tools 120 along the drill string system 108. Other factors that may influence the placement of an axial oscillation tool 120 include expected flow rates, required weight-on-bit, formation friction coefficient, the presence of cuttings buildup, partial formation collapse, internal pipe pressure, drill string geometry, drill string segment type, location of a drill string segment, a buoyancy factor, inclination of the wellbore, diameter of the wellbore, smoothness of the surface of the wellbore walls, rock abrasion resistance, tendency for differential sticking, mud factors, and the stickiness of the formation. Notwithstanding the above, one of ordinary skill in the art will appreciate that, in addition to the technical considerations discussed above, in some applications, monitored conditions, subsequent bit runs, the ability to reposition, remove, or add tools present themselves and may dictate the placement or placements. One of ordinary skill in the art will also appreciate that local compression or tension and axial elasticity of the drill string system 108 may dictate placement.

Continuing, FIG. 1B shows a drilling rig 100*b* drilling a lateral section of a wellbore 124*a* with a conventional axial oscillation tool 120 disposed downhole. Generally, in a vertical section of the wellbore 124*a*, the axial drag and frictional forces are typically less than that in a corresponding horizontal section. As such, if the trajectory of the well path includes one or more kickoffs, tangential sections, or lateral sections, the drill string 108, or portions thereof, have a tendency to sit on the floor of wellbore wall 124*b*. In addition, due to the fact that the drill string system 108 is typically not rotated during directional or slide drilling operations, drag and friction are substantially increased as compared to during rotation. This is particularly problematic when drilling long wells with long lateral sections due to increased drag and frictional forces encountered. Torque and force analysis show that helical and sinusoidal buckling can occur in lateral sections and these zones prevent the proper transmission of surface lading to the drill bit 116. This substantially reduces the rate of penetration ("ROP") during drilling operations and often limits the lateral reach of the wellbore itself.

FIG. 2A shows a perspective view of a stator 202 and a rotor 212 of an axial valve mechanism 200 of a conventional axial oscillation tool (e.g., 120 of FIG. 1). A conventional axial oscillation tool (e.g., 120 of FIG. 1) typically includes an axial valve mechanism (e.g., 200) that is controlled by an axial oscillation tool control system that dictates the degree to which the axial valve mechanism is open, partially opened/closed, or closed and the rate of change of the position of the valve. For example, in some applications a servomechanism (not shown) may control the precise position of the valve 200 permitting incremental positional control, provide fixed incremental steps, or lock and hold a position until a new position is commanded. Regardless of the approach, the servomechanism (not shown) controls the position of the valve mechanism 200. In some applications, the servomechanism (not shown) may include an electric or hydraulic motor (not shown). Returning to the figure, axial valve mechanism 200 may include a stator 202 and a rotor 212, where the stator 202 is stationary relative to the axial oscillation tool (e.g., 120 of FIG. 1) and may include a profile that prevents or limits movement of the stator 202. The stator 202 may include a plurality of blades 204 that extend radially from a middle portion 206 towards the perimeter 208 of the stator 202. The location of the blades 204 form passageways 210 in between the blades 204. Similarly, the rotor 212 may include a plurality of blades 214 that extend radially from a middle portion 216 towards the perimeter 218 of the rotor 212. The location of the blades 214 form passageways 220 in between the blades 214. The rotor 212 rotates relative to the stationary stator 202. As the rotor 212 rotates relative to the stator 202, their respective blades 204, 214 form apertures that controllably permit fluid flow therethrough.

Continuing, FIG. 2B shows an aperture (e.g., overlap of 210/220) of the axial valve mechanism 200 with the stator 202 and rotor 212 aligned for maximum flow. The axial valve mechanism 200 may be disposed as part of the axial oscillation tool (e.g., 120 of FIG. 1A or 1B) in line with the axial flow of drilling fluids down the drill string (e.g., 108 of FIG. 1A or 1B). As such, drilling fluids are pumped down the drill string (e.g., 108 of FIG. 1A or 1B) and the aperture of the valve mechanism 200 dictates the extent of flow therethrough. In FIG. 2B, the full alignment of stator blades 204 and rotor blades 212 maximizes the passageway 210/220 through which drilling fluids may pass. Continuing, FIG. 2C shows an aperture 210/220 of the axial valve mechanism 200 with the stator 202 and rotor 212 aligned for reduced flow. Continuing, FIG. 2D shows an aperture 210/220 of the axial valve mechanism 200 with the stator 202 and rotor 212 aligned for further reduced flow. In certain applications, when the valve mechanism 200 is partially or fully closed, the pressure differential across the valve mechanism 200 may increase, the flow of drilling fluids through the interior of the drill string system (e.g., 108 of FIG. 1A or 1B) is restricted or stopped, and the pressure on a top side of the valve mechanism 200 is greater than a pressure on a bottom side of the valve mechanism 200. Similarly, when the valve mechanism 200 is partially or fully opened, the pressure differential decreases.

The axial oscillation tool (e.g., 120 of FIG. 1A or 1B) may include one or more operating parameters that define its operation including a position of the valve at a fully opened state, a position of the valve at a fully closed state, an interval of time between the maximum opened and maximum closed positions, a rate of change between the maximum opened and maximum closed positions or between the maximum closed and maximum opened positions, and a variable rate of change between the maximum opened and maximum closed positions or between the maximum closed and maximum opened positions. As such, the operating parameters of the axial oscillation tool (e.g., 120 of FIG. 1A or 1B) control or affect at least the first order, second order, and third order derivative of position, such that the parameters control the tool stroke velocity, tool stroke acceleration, and the tool stroke jerk. In some applications, the axial oscillation tool (e.g., 120 of FIG. 1A or 1B) may create a specific valve position impulse and therefore a corresponding tool stroke jerk in order to unstick or jar loose a stuck interval of the drill string system 108. Notwithstanding the above, the axial oscillation tool control system (e.g., 320 of FIG. 3) disposed downhole controls the operation of the axial oscillation tool (e.g., 120 of FIG. 1A or 1B). In certain embodiments, the parameters passed to the tool (e.g., 120 of FIG. 1A or 1B) may include one or more of a frequency (or period) and an amplitude of axial pressure pulses to be generated, related parameters in different form, or other parameters that produce the intended result. In other embodiments, the tool (e.g., 120 of FIG. 1A or 1B) may be commanded in a manner that allows control of the time spent in transitions between open and closed states of the valve mechanism 200 and/or the duration of time spent fully opened or fully closed. While the amplitude of the pressure pulses if critical, it is also important to recognize that the overall shape of the pressure pulse waveform over a full cycle is also important. The shape of the pressure pulse waveform may be controlled by geometry of the valve mechanism 200, the maximum amount of bypass in the open and closed states, and the duration of time spent in each position while transitioning through the full waveform or velocity of the valve rotation/oscillation/reciprocation depending on the type of valve mechanism 200 being used.

The axial oscillation tool (e.g., 120 of FIG. 1A or 1B) may be used to create movement, or vibration, relative to the wellbore wall (e.g., 124*b* of FIG. 1A or 1B), of at least a portion of the drill string (e.g., 108 of FIG. 1A or 1B) in the vicinity of the axial oscillation tool (e.g., 120 of FIG. 1A or 1B). Accordingly, the axial oscillation tool (e.g., 120 of FIG. 1A or 1B) may create localized movement of at least a portion of the drill string system (e.g., 108 of FIG. 1A or 1B) in the vicinity of the axial oscillation tool (e.g., 120 of FIG. 1A or 1B). While valve mechanism 200 is merely exemplary, one of ordinary skill in the art will appreciate that any type or kind of axial valve mechanism, including those that potentially use a singular passageway, may be used including, for example, a poppet valve, a bean choke valve, a ball valve, a butterfly valve, a globe valve, a check valve, a piston valve, or a rotational valve. Moreover, one of ordinary skill in the art will appreciate that, while their respective modes of operation may vary, any axial valve mechanism capable of controllably generating an axial pressure pulse or series of axial pressure pulses down the drill string system (e.g., 108 of FIG. 1A or 1B) may be used in accordance with one or more embodiments of the present invention.

The current state of the art in the industry is to use one or more conventional axial oscillation tools (e.g., 120 of FIG. 1A or 1B) in the lateral section of the drill string system (e.g., 108 of FIG. 1B) during directional or slide drilling operations, typically 1000 feet or more back from the drill bit. The one or more axial oscillation tools (e.g., 120 of FIG. 1A or 1B) provide axial pressure pulses to the drill string (e.g., 108 of FIG. 1B) to help break the friction, move the drill string (e.g., 108 of FIG. 1B), and increase the ROP. While the axial valve mechanism 200 of axial oscillation tools (e.g., 120 of FIG. 1A or 1B) may vary from vendor to vendor, they are typically powered by a downhole power section (not independently illustrated) including a stator and a rotor where the torque from the power section controls the axial valve mechanism (e.g., 200), thereby causing pressure fluctuations or pulses in the drilling fluid flowing therethrough. Typically, the axial oscillation tool (e.g., 120 of FIG. 1A or 1B) includes a motor that controls the axial valve mechanism (e.g., 200) of the axial oscillation tool (e.g., 120 of FIG. 1A or 1B) that controllably restricts flow in the axial direction of the drill string (e.g., 108 of FIG. 1B), thereby creating backpressure above, and a pressure differential across, the valve mechanism (e.g., 200). This in turn creates an axial force that potentially causes the drill string (e.g., 108 of FIG. 1B) to shift or move if it is sufficient to overcome frictional forces. The amplitude of the pressure pulses depend on what percentage of flow is restricted by the valve mechanism (e.g., 200) of the axial oscillation tool (e.g., 120 of FIG. 1A or 1B) and the frequency of the pressure pulses depend on how fast the axial valve mechanism (e.g., 200) is oscillating.

Conventional axial oscillation tools are constrained by the amplitude and the frequency for a given set of hydraulic conditions, are not optimized, and are not capable of optimization. This is because the downhole axial oscillation tool control system itself commands the amplitude and frequency to the downhole axial oscillation tool without an awareness of downhole conditions or changes in downhole conditions. Further, since the amplitude of axial pressure pulses increase with the square of the flow rate of drilling fluids and the frequency of axial pressure pulses increases linearly with the flow rate of drilling fluids, other rig parameters can inadvertently change the effective operating parameters of the axial oscillation tool. Since the flow rate varies considerably from well to well and based on the operations being conducted, conventional axial oscillation tools are typically operated well outside of optimum parameters. Also, the current state of the art fails to provide any means to determine an axial impulse that maximizes the ROP or how to optimally control an axial oscillation tool disposed downhole.

Currently, most conventional axial oscillation tools are operated at a frequency in a range between 2 cycles per second ("Hz") and 20 Hz with pulse amplitudes from 200 pounds per square inch ("psi") to 1000 psi, but there is limited insight into which conditions produce the optimum ROP for a given application. A conventional axial oscillation tool may use 300 psi to 600 psi of the available pressure rating of the drilling rig. This translates into several hundred horsepower of the drilling rig power budget. As such, maintaining the desired axial oscillation with lower power consumption would provide significant power savings, or alternatively, allow for the hydraulic power to be applied to other drilling equipment such as the mud motor, the drill bit, or increasing the ROP and efficiency of the drilling operations.

Accordingly, in one or more embodiments of the present invention, a method and system for downhole pulse generation determines an optimal frequency and, in some embodiments, amplitude of axial pressure pulses, and/or timing or phasing of such parameters to maximize the ROP. Specifically, one or more sensors may be disposed on or near the axial oscillation tool that provides near real-time raw sensor data relating to speed, velocity, acceleration, or displacement of the tool. Near real-time means real-time delayed by measurement, calculation, and/or transmission only, but typically on the order of magnitude of mere seconds or less. With this sensor data, an optimal set of parameters, namely an optimal frequency and, in some embodiments, amplitude may be determined based on the hydraulic conditions and frictional forces of the actual drilling environment. An optimizing control system may directly communicate these parameters to the axial oscillation tool or pass the parameters to an axial oscillation tool control system that controls the operation of the axial oscillation tool. Advantageously, frictional forces may be substantially reduced, the ROP may be substantially enhanced, and power consumption may be reduced, intelligently allocated, and more precisely managed.

Figure 3:
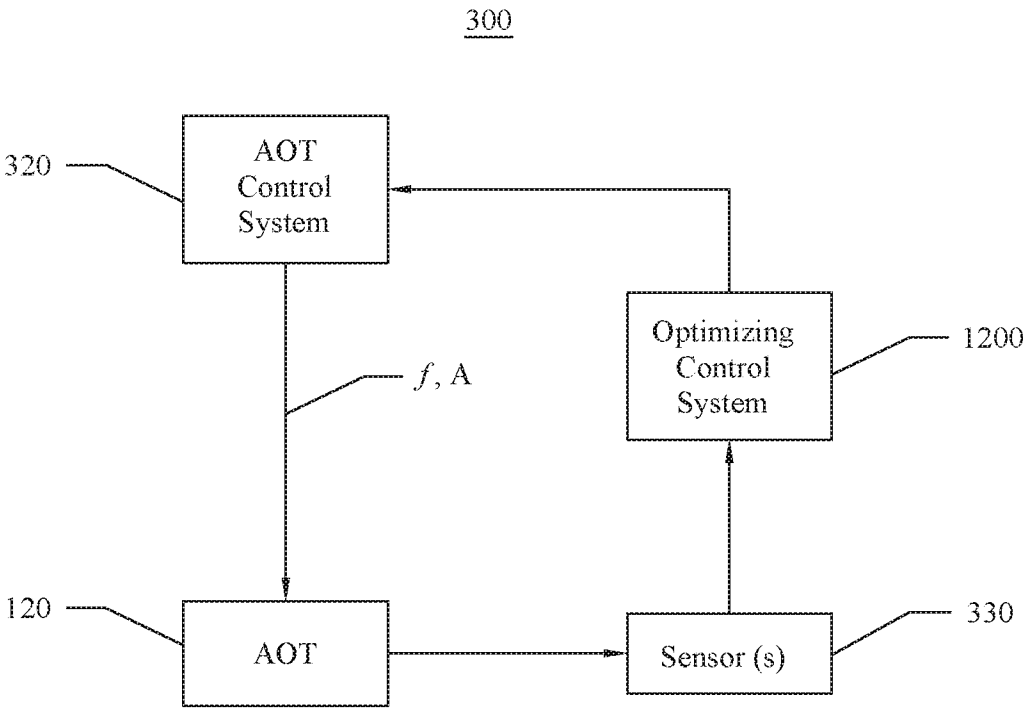
FIG. 3 shows a system for downhole pulse generation in accordance with one or more embodiments of the present invention.

FIG. 3 shows a system 300 for downhole pulse generation in accordance with one or more embodiments of the present invention. Conventional drilling systems typically include one or more axial oscillation tools 120 disposed downhole as part of the drill string (e.g., 108 of FIG. 1A or 1B) as well as an axial oscillation tool control system 320 that controls one or more axial oscillation tools 120. The axial oscillation tool control system 320 typically commands an axial oscillation tool 120 to a frequency and an amplitude that governs the axial pressure pulses generated by the axial oscillation tool 120. In one or more embodiments of the present invention, one or more sensors 330 may be disposed on or near the axial oscillation tool 120 as a proxy for measuring the behavior of the drill string (e.g., 108 of FIG. 1A or 1B). If the axial oscillation tool is run with a compliant member, one or more sensors 330 may be disposed on the axial oscillation tool 120 itself. However, if run with a shock sub, where one side moves independent of the other, one or more sensors 330 may be disposed near, or adjacent to, the axial oscillation tool. In such embodiments, one or more sensors 330 may be disposed on equipment attached to either side of the axial oscillation tool 120, but the bottom side is typically preferred.

In certain embodiments, a sensor 330 may be an accelerometer. The accelerometer may be one-axis, two-axis, or three-axis accelerometer that outputs either an analog signal or digital values corresponding to acceleration. In other embodiments, a sensor 330 may be a pressure transducer that measures an increase in pressure from the axial valve mechanism or the differential pressure across the axial valve mechanism of the axial oscillation tool. In still other embodiments, a sensor 330 may be a displacement sensor that measures the stroke position of a shock sub (not shown) attached to the axial oscillation tool 120. One of ordinary skill in the art will recognize that any sensor 330 or combination of sensors 330 may be used to provide data used to optimize the parameters of the one or more axial oscillation tools 120 in accordance with one or more embodiments of the present invention. In addition, an optimizing control system 1200 may receive raw sensor data from the one or more sensors 330, determine optimized parameters for frequency and/or amplitude, and command, either directly or indirectly, the axial oscillation tool 120 to generate axial pressure pulses in accordance with the optimized frequency and/or amplitude. In certain embodiments, the optimizing control system 1200 may directly command the axial oscillation tool 120 to generate axial pressure pulses having the optimized frequency and/or amplitude. In other embodiments, the optimizing control system 1200 may indirectly command the axial oscillation tool 120 by passing the optimal parameters for frequency and/or amplitude to the axial oscillation tool control system 1200 that in turn commands the axial oscillation tool 120 to the commanded frequency and amplitude. One of ordinary skill in the art will appreciate that, due to telemetry issues, the optimizing control system 1200 is disposed downhole to facilitate sensing and communication with axial oscillation tool control system 320 in near real-time.

In one or more embodiments of the present invention, various optimization methods are disclosed that may be used independently or in combination to determine the optimal parameters for the operation of one or more axial oscillation tools to maximize the ROP. In certain embodiments, one or more frequency optimization methods may be used to determine a conditional dominant or resonant frequency that depends on many factors and may change dynamically during drilling operations. Once the conditional dominant or resonant frequency is determined, the axial oscillation tool may be commanded to generate axial pressure pulses having, or very nearly having, the dominant or resonant frequency, thereby causing the drill string to oscillate at or near the dominant or resonant frequency. Advantageously, frictional forces are reduced, the ROP is substantially enhanced, and power consumption may be reduced, allowing saved power to be allocated to other equipment.

Figure 4:
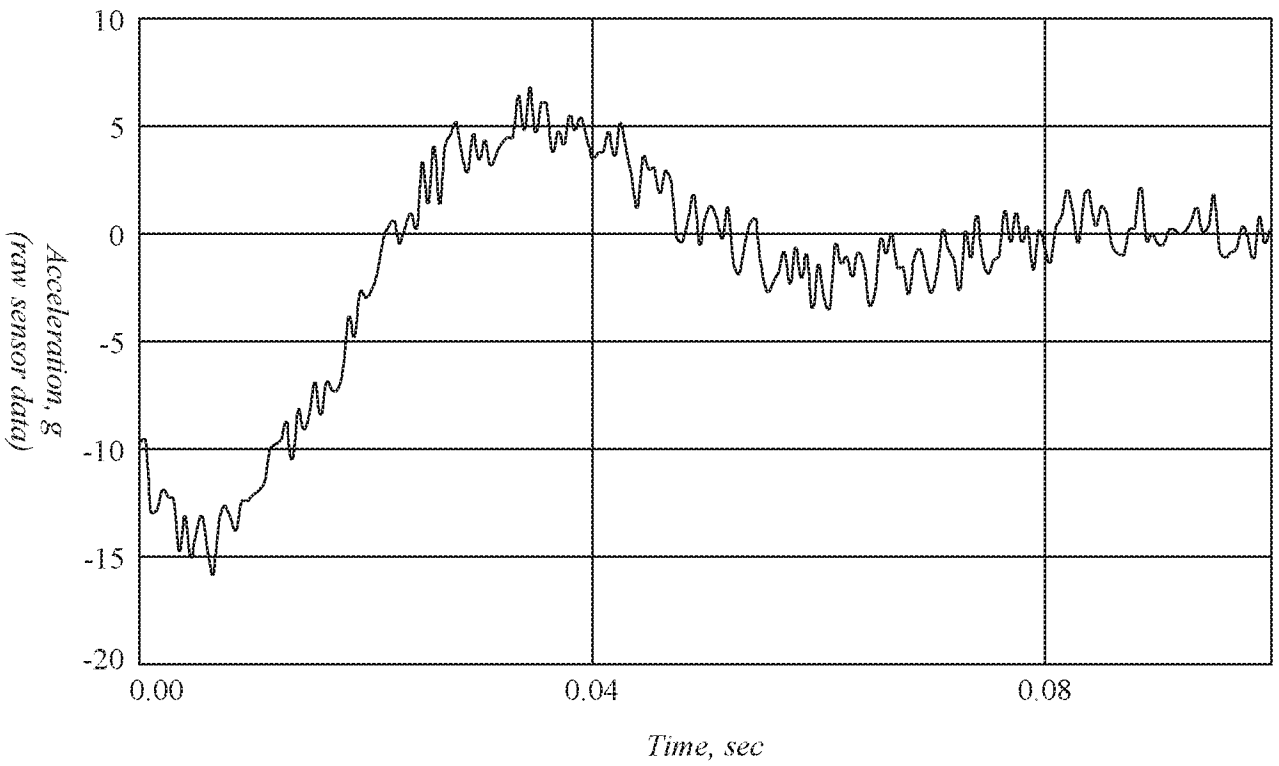
FIG. 4 shows an example of raw sensor data provided by an accelerometer disposed on or near an axial oscillation tool in accordance with one or more embodiments of the present invention.

FIG. 4 shows an example of raw sensor data 400 provided by an accelerometer (not shown) disposed on or near an axial oscillation tool (e.g., 120 of FIG. 1A or 1B) in accordance with one or more embodiments of the present invention. In one or more embodiments of the present invention, an axial oscillation tool (e.g., 120 of FIG. 1A or 1B) may be commanded to generate an initial axial pressure pulse or series of axial pressure pulses having a predetermined amplitude and frequency down the drill string (e.g., 108 of FIG. 1A or 1B) towards the drill bit (e.g., 116 of FIG. 1A or 1B). For initial values, historical data, models, or simulations may be used. The optimizing control system (1200 of FIG. 3) may receive raw sensor data from the sensor (not shown) disposed on or near the axial oscillation tool (e.g., 120 of FIG. 1A or 1B) that includes time-domain sensor output data, such as, for example, the exemplary time-domain acceleration data shown in the figure that is output from an accelerometer (sensor). In certain embodiments, the data may be analog. In other embodiments, the data may be digital. To determine how best to proceed with this time-domain sensor output data, the nature of the damping of the system may be investigated. While the example shows use of an accelerometer type of sensor and the time-domain sensor output data comprises time-domain acceleration data, one of ordinary skill in the art will recognize that other types or kinds of sensors as well as other types or kinds of sensor output data may be used, including, for example, pressure transducers and stroke position sensors and their corresponding sensor output data.

Figure 5:
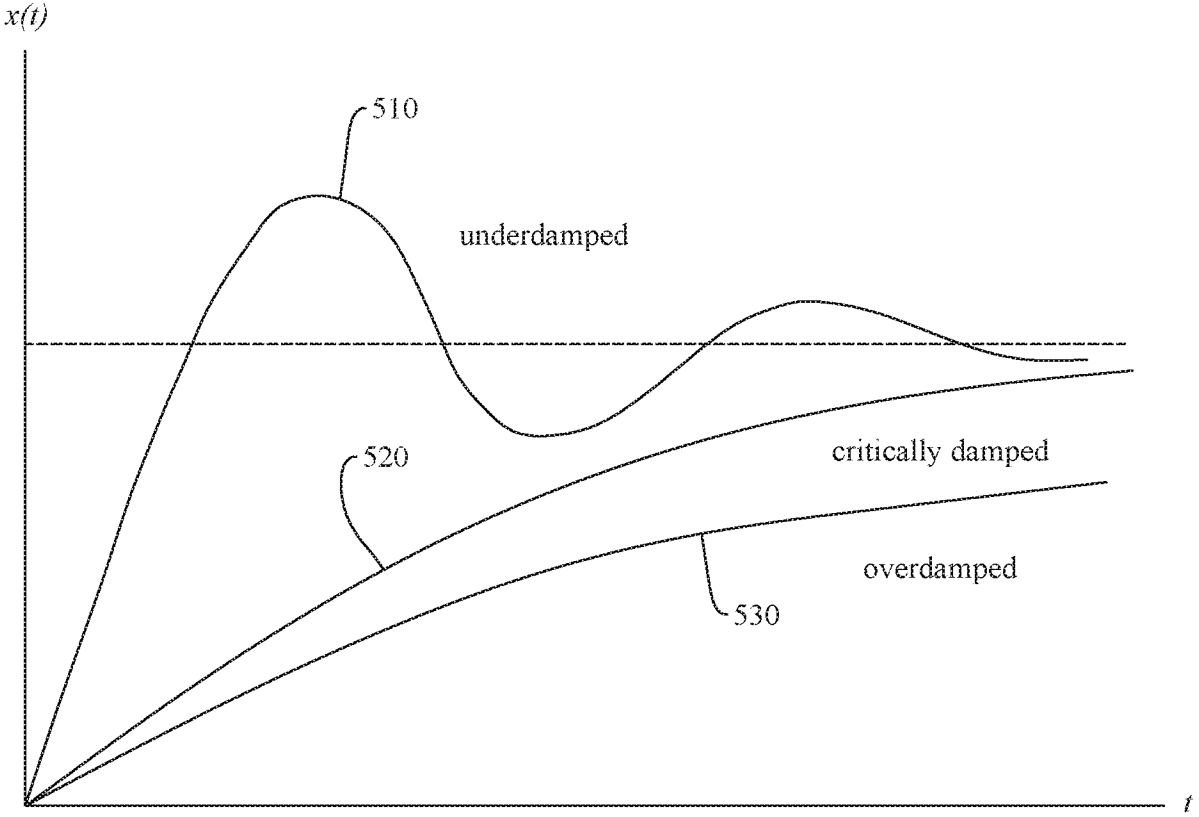
FIG. 5 shows an example of underdamped, critically damped, and overdamped oscillations in accordance with one or more embodiments of the present invention.

FIG. 5 shows an example of underdamped, critically damped, and overdamped oscillations 500 in accordance with one or more embodiments of the present invention. For purposes of illustration, damped harmonic motion classifies an output signal x(t) representative of the oscillating behavior of a system as being either overdamped, critically damped, or underdamped. Generally, an overdamped system, having a damping ratio $\zeta>1$, returns to equilibrium without oscillating. A critically damped system, having a damping ratio $\zeta=1$, returns to equilibrium as fast as possible, also without oscillating. However, an underdamped system, having a damping ratio $0<\zeta<1$, oscillates with the amplitude of oscillation decreasing to zero over time t. If the drill string (e.g., 108 of FIG. 1A or 1B) is underdamped, as is shown in FIG. 1, one or more methods may be used to determine the dominant or resonant frequency that maximizes the ROP.

Figure 6:
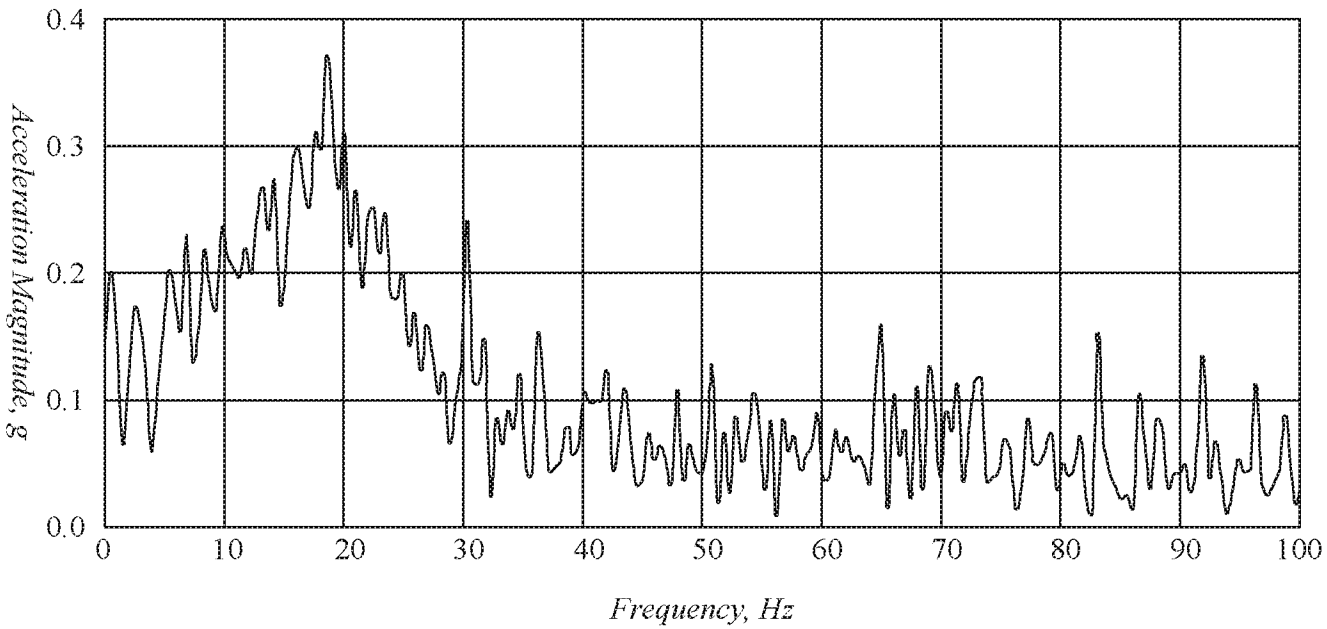
FIG. 6 shows an example of a Fast Fourier Transform of raw sensor data provided by an accelerometer disposed on or near an axial oscillation tool in accordance with one or more embodiments of the present invention.

In one or more embodiments of the present invention, the Fast Fourier Transform may be used to determine a conditional dominant or resonant frequency. FIG. 6 shows an example of a Fast Fourier Transform of raw sensor data 600 provided by a sensor, in this instance an accelerometer, (not shown) disposed on or near an axial oscillation tool (e.g., 120 of FIG. 1A or 1B) in accordance with one or more embodiments of the present invention.

The axial oscillation tool control system (320 of FIG. 3) may command, or the optimizing control system (1200 of FIG. 3) may command, directly or indirectly, the axial oscillation tool (e.g., 120 of FIG. 1A or 1B) to generate an initial axial pressure pulse or series of axial pressure pulses having a predetermined amplitude and frequency down the drill string system (e.g., 108 of FIG. 1A or 1B). The predetermined amplitude and frequency may be based on last known or used values, simulated values, modeled values, heuristic values, or user input. In certain embodiments, the predetermined amplitude may be in a range between 50 and 2000 psi and the predetermined frequency may be in a range between 0.5 and 30 Hz. One of ordinary skill in the art will recognize that the above-noted ranges may vary based on equipment, operating conditions, and the nature of the application or design. The optimizing control system (1200 of FIG. 3) may receive raw sensor data from a sensor (e.g., 330 of FIG. 3), such as, for example, an accelerometer disposed on or near the axial oscillation tool (e.g., 120 of FIG. 1A or 1B). The raw sensor data may include time-domain sensor output data from the sensor (e.g., 330 of FIG. 3) as a proxy for the drill string (e.g., 108 of FIG. 1A or 1B) itself. The raw sensor data may include, but is not limited to, one or more of time-domain acceleration data, pressure data, or stroke position, or axial displacement, data that are capable of conveying information about the performance of the axial oscillation tool (e.g., 120 of FIG. 1A or 1B). In certain embodiments where more than one sensor is used, the raw sensor data may include more than one of time-domain acceleration data, pressure data, or axial displacement data. In other embodiments, where more than one sensor is used, the raw sensor data may include axial acceleration data, axial displacement data, pressure data, or combinations thereof. For example, axial displacement of the shock sub alone may not provide an indication of which side of the shock sub was displaced. As such, axial acceleration may be sensed in combination with axial displacement to provide an indication of which direction the drill string system (e.g., 108 of FIG. 1A or 1B) actually moved.

As shown in the example of FIG. 4, time-domain sensor output data may include sensor data, in this instance axial acceleration data, as a function of time. Assuming the raw sensor data for a given application confirms that the system is in fact underdamped and oscillating, the optimizing control system (1200 of FIG. 3) may perform a Fast Fourier Transform of the raw sensor data to obtain frequency-domain sensor output data, in this instance frequency-domain acceleration data, such as, for example, that shown in FIG. 6. The frequency-domain acceleration data may include axial acceleration as a function of frequency, thereby graphically identifying the dominant or resonant frequency. In other embodiments, frequency-domain sensor output data may include frequency-domain axial displacement data (not shown) that includes axial displacement as a function of frequency. In other embodiments, frequency-domain sensor output data may include frequency-domain pressure data (not shown) that includes pressure data as a function of frequency. Notwithstanding, the dominant or resonant frequency may be determined from the frequency-domain sensor output data by determining the frequency at which the frequency-domain sensor data, in this instance, acceleration as a function of frequency, has a maximum value. In the example depicted, the dominant frequency is approximately 18 Hz.

The optimizing control system (1200 of FIG. 3) may command the axial oscillation tool (e.g., 120 of FIG. 1A or 1B), directly or indirectly, to change the predetermined frequency to the dominant or resonant frequency, thereby substantially enhancing the ROP. In certain embodiments, the optimizing control system (1200 of FIG. 3) may command the axial oscillation tool (e.g., 120 of FIG. 1A or 1B) directly by commanding or otherwise directly passing parameters. In other embodiments, the optimizing control system (1200 of FIG. 3) may command the axial oscillation tool (e.g., 120 of FIG. 1A or 1B) indirectly by passing one or more parameters, such as the dominant or resonant frequency, to the axial oscillation tool control system (320 of FIG. 3), where the axial oscillation tool control system (320 of FIG. 3) commands the axial oscillation tool (e.g., 120 of FIG. 1A or 1B) to change the predetermined frequency to the dominant or resonant frequency.

Figure 7:
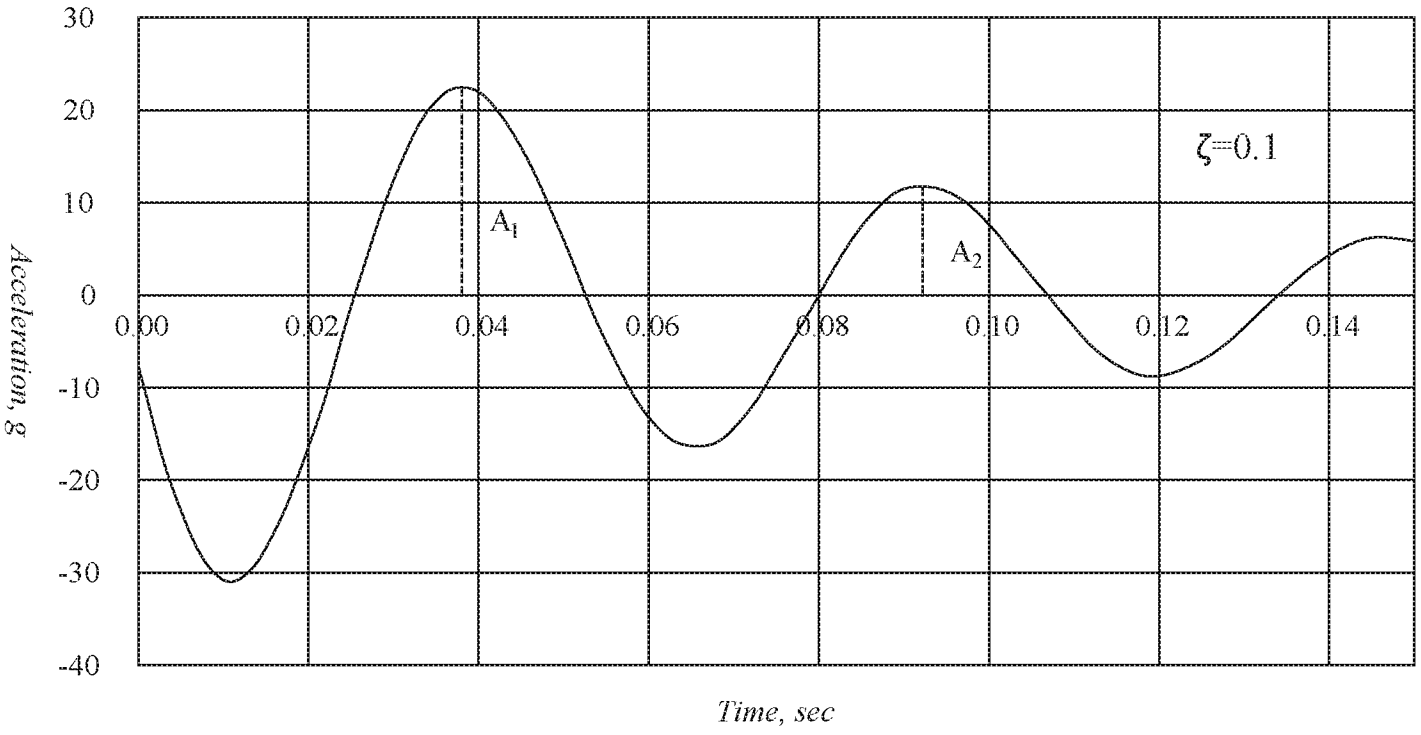
FIG. 7 shows an example of a plot of acceleration as a function of time used to calculate a logarithmic decrement in accordance with one or more embodiments of the present invention.

In one or more embodiments of the present invention, a logarithmic decrement, as a measure of the decay of acceleration, may be used to determine a conditional dominant or resonant frequency. FIG. 7 shows an example of a plot of acceleration as a function of time 700 that may be used to calculate a logarithmic decrement in accordance with one or more embodiments of the present invention.

The axial oscillation tool control system (320 of FIG. 3) may command, or the optimizing control system (1200 of FIG. 3) may command, directly or indirectly, the axial oscillation tool (e.g., 120 of FIG. 1A or 1B) to generate an initial axial pressure pulse or series of axial pressure pulses having a predetermined amplitude and frequency down the drill string (e.g., 108 of FIG. 1A or 1B). The predetermined amplitude and frequency may be based on last known or used values, simulated values, modeled values, heuristic values, or user input. In certain embodiments, the predetermined amplitude may be in a range between 50 and 2000 psi and the predetermined frequency may be in a range between 0.5 and 30 Hz. One of ordinary skill in the art will recognize that the above-noted ranges may vary based on an application or design. The optimizing control system (1200 of FIG. 3) may receive raw sensor data from a sensor (e.g., 330 of FIG. 3), such as, for example, an accelerometer disposed on or near the axial oscillation tool (e.g., 120 of FIG. 1A or 1B). The raw sensor data may include time-domain sensor output data for the sensor (e.g., 330 of FIG. 3) as a proxy for the drill string (e.g., 108 of FIG. 1A or 1B) itself. As shown in the example of FIG. 7, the successive first, $A_1$, and second $A_2$, amplitude peaks may be determined from the time-domain sensor output data, in this example time-domain acceleration data. One of ordinary skill in the art having the benefit of this disclosure will recognize that in other embodiments, time-domain sensor output data may comprise time-domain axial displacement data or time-domain pressure data. A logarithmic decrement, δ, representing the rate at which the amplitude of a free damped vibration decreases, may be calculated by the optimizing control system (1200 of FIG. 3) as the natural logarithm of the ratio of the second amplitude peak to the first amplitude peak:

$$\delta = \ln\frac{A_2}{A_1}. \tag{1}$$

A damping ratio, ζ, may be calculated by the optimizing control system (1200 of FIG. 3) based on the logarithmic decrement, δ, representing the ratio of actual damping to critical damping:

$$\zeta = \frac{\delta}{\sqrt{4\pi^2 + \delta^2}}. \quad (2)$$

If the damping ratio, $\zeta$, is in the range, $0<\zeta<1$, then the system is considered underdamped and subject to oscillations. The period between the successive first and second amplitude peaks may be determined as the time between successive peaks, in this instance, the period T is 0.05 seconds. As such, the damped angular frequency, $\omega_D$, may be calculated by:

$$\omega_D = \frac{2\pi}{T}. \quad (3)$$

In this example, the damped angular frequency may be calculated to be approximately 120 radians per second. The optimizing control system (1200 of FIG. 3) may calculate a dominant or resonant frequency from the calculated damped angular frequency, $\omega_D$, by converting radians per second to cycles per second, or Hz, which in this example may be calculated to be approximately 19 Hz.

The optimizing control system (1200 of FIG. 3) may command the axial oscillation tool (e.g., 120 of FIG. 1A or 1B), directly or indirectly, to change the predetermined frequency to the dominant or resonant frequency, thereby substantially enhancing the ROP. In certain embodiments, the optimizing control system (1200 of FIG. 3) may command the axial oscillation tool (e.g., 120 of FIG. 1A or 1B) directly by commanding or otherwise directly passing parameters. In other embodiments, the optimizing control system (1200 of FIG. 3) may command the axial oscillation tool (e.g., 120 of FIG. 1A or 1B) indirectly by passing one or more parameters, such as the dominant or resonant frequency, to the axial oscillation tool control system (320 of FIG. 3), where the axial oscillation tool control system (320 of FIG. 3) commands the axial oscillation tool (e.g., 120 of FIG. 1A or 1B) to change the predetermined frequency to the dominant or resonant frequency.

Figure 8A:
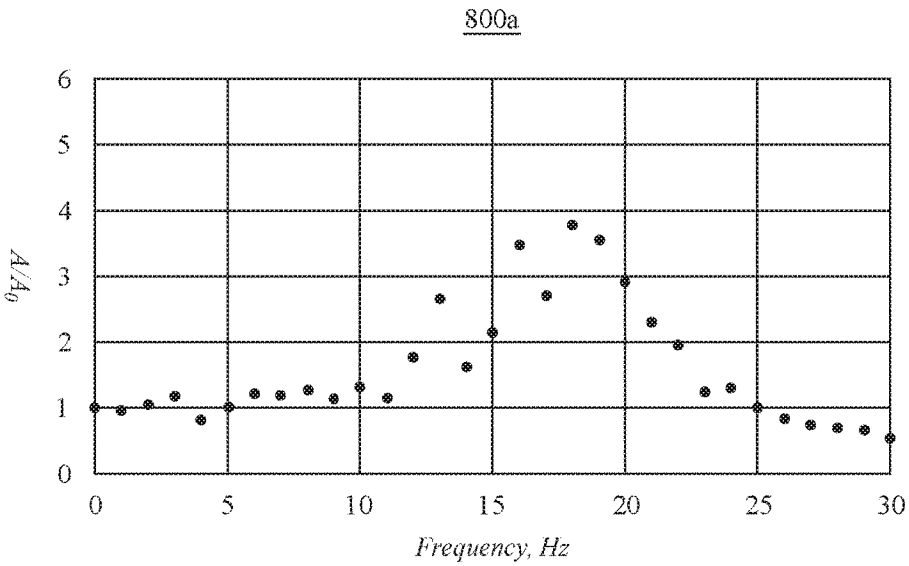
FIG. 8A shows an example of a normalized acceleration plot as a function of frequency in accordance with one or more embodiments of the present invention.

In one or more embodiments of the present invention, a swept sinusoid may be used to produce an output response across the full frequency range of the axial oscillation tool via a frequency response function, sometimes referred to as a transmissibility curve, to determine a conditional dominant or resonant frequency. FIG. 8A shows an example of a normalized acceleration plot as a function of frequency 800*a* in accordance with one or more embodiments of the present invention. One of ordinary skill in the art having the benefit of this disclosure will recognize that in other embodiments, a normalized axial displacement plot as a function of frequency or a normalized pressure plot as function of frequency. In essence, axial pressure pulses with a known amplitude and frequency may be generated, constituting a sinusoidal input to the drill string (e.g., 108 of FIG. 1A or 1B) system. After a period of time, the drill string (e.g., 108 of FIG. 1A or 1B) will oscillate with the steady state frequency. Measuring the output response at the steady state may then be used to determine the dominant or resonant frequency as described in more detail herein.

Figure 8B:
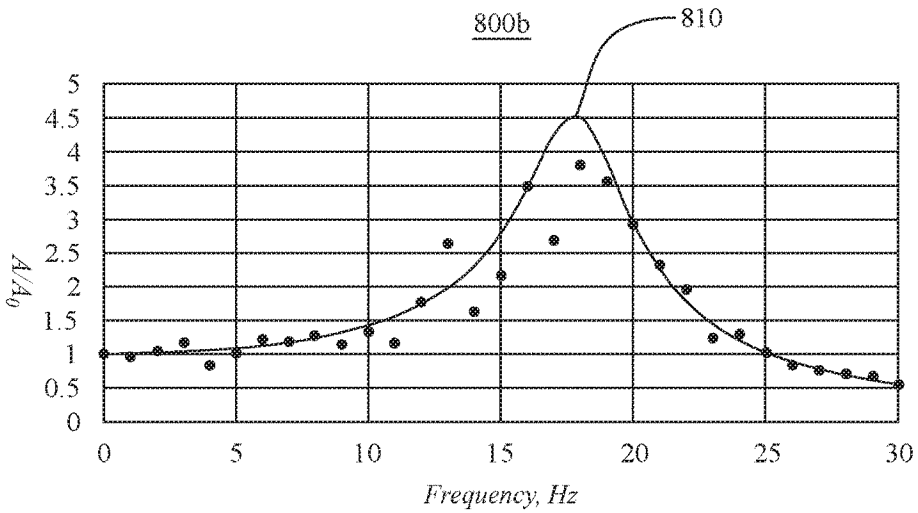
FIG. 8B shows a parameterization of the example of normalized acceleration plot as a function of frequency in accordance with one or more embodiments of the present invention.

The optimizing control system (1200 of FIG. 3) may command, directly or indirectly, the axial oscillation tool (e.g., 120 of FIG. 1A or 1B) to generate an axial pressure pulse or series of axial pressure pulses corresponding to a swept sinusoid having an initial amplitude, initial frequency, and frequency step size that may vary from cycle to cycle. The initial amplitude, initial frequency, and frequency step size may be based on last known values, simulated values, modeled values, heuristic values, or user input. In certain embodiments, the initial amplitude may be in a range between 50 and 2000 psi, the frequency range may be swept from 0.5 to 30 Hz where the initial frequency is the smallest value in the frequency range to be swept, and the frequency step size may be in a range between 0.1 and 5 Hz, but may vary from cycle to cycle to allow for course adjustments. One of ordinary skill in the art will recognize that the above-noted ranges may vary based on an application or design. The optimizing control system (1200 of FIG. 3) may measure an output response corresponding to oscillation of the drill string system (e.g., 108 of FIG. 1A or 1B) and may determine a measured amplitude of the output response at each frequency step. Then, the optimizing control system (1200 of FIG. 3) may calculate a ratio of measured amplitude to initial amplitude at each frequency step constituting an unparameterized data set, such as that depicted by the example plot shown in FIG. 8A. Continuing, FIG. 8B shows a parameterization of the example of normalized acceleration plot as a function of frequency 800*b* to a mathematical function to find a peak value frequency in accordance with one or more embodiments of the present invention. This can be any function that produces a peak, such as a polynomial function, a trigonometric function, a transmissibility curve shape, maximum average values function, or any other non-linear function. The parameterization can be done by a least squares method, or by any other method known in the art. Using well known mathematical techniques, the data set from the example of FIG. 8A may be parameterized to generate a transmissibility curve function as shown in FIG. 8B. The optimizing control system (1200 of FIG. 3) may determine a dominant or resonant frequency from the transmissibility curve function, where the dominant or resonant frequency may correspond to a maximum value 810 for normalized acceleration on the transmissibility curve, in this example, approximately 18 Hz. One of ordinary skill in the art having the benefit of this disclosure will recognize that in other embodiments, a maximum value (not shown) of a normalized axial displacement plot (not shown) as a function of frequency or a maximum value (not shown) of a normalized pressure plot (not shown) as function of frequency may be used.

The optimizing control system (1200 of FIG. 3) may command the axial oscillation tool (e.g., 120 of FIG. 1A or 1B), directly or indirectly, to change the predetermined frequency to the dominant or resonant frequency, thereby substantially enhancing the ROP. In certain embodiments, the optimizing control system (1200 of FIG. 3) may command the axial oscillation tool (e.g., 120 of FIG. 1A or 1B) directly by commanding or otherwise directly passing parameters. In other embodiments, the optimizing control system (1200 of FIG. 3) may command the axial oscillation tool (e.g., 120 of FIG. 1A or 1B) indirectly by passing one or more parameters, such as the dominant or resonant frequency, to the axial oscillation tool control system (320 of FIG. 3), where the axial oscillation tool control system (320 of FIG. 3) commands the axial oscillation tool (e.g., 120 of FIG. 1A or 1B) to change the predetermined frequency to the dominant or resonant frequency.

One of ordinary skill in the art having the benefit of this disclosure will recognize that the dominant frequency may be determined used a fixed initial amplitude or a series of frequency sweeps may be performed where the initial amplitude is varied over the range of amplitudes. In addition, one of ordinary skill in the art having the benefit of this disclosure will appreciate that a peak set of measurements, the peak-to-peak range in a set, the root-mean-square method, or any other method of determining the amplitude from a varying data set may be used in accordance with one or more embodiments of the present invention.

Figure 9A:
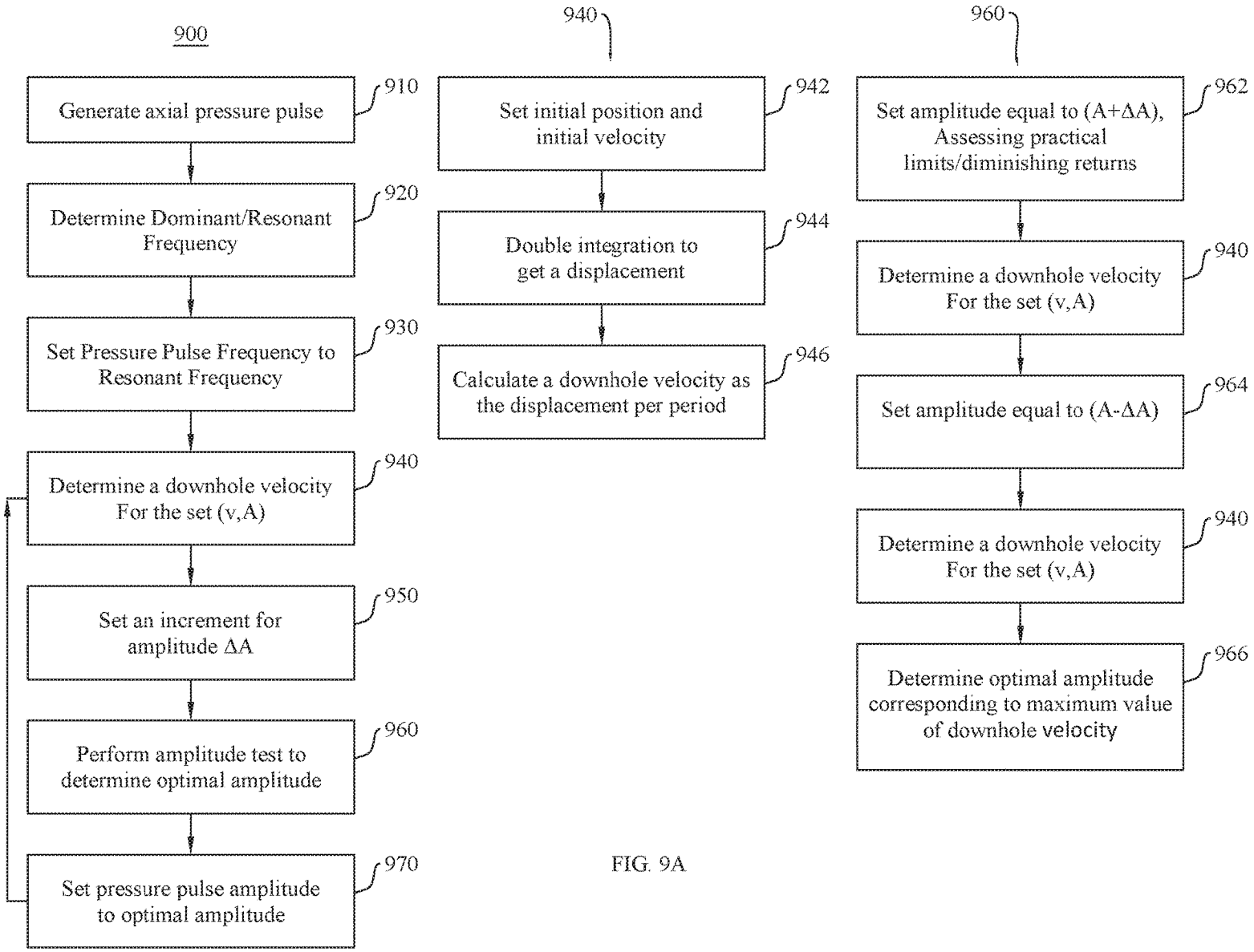
FIG. 9A shows a velocity method of downhole pulse generation in accordance with one or more embodiments of the present invention.

In one or more embodiments of the present invention, the displacement per period, which is a vector measure of the difference between the final and initial positions of the sensor as proxy for the drill string, may be used to determine a conditional dominant or resonant frequency and optimal amplitude. FIG. 9A shows a velocity method of downhole pulse generation 900 in accordance with one or more embodiments of the present invention.

In step 910, the axial oscillation tool control system (320 of FIG. 3) may command, or the optimizing control system (1200 of FIG. 3) may command, directly or indirectly via the axial oscillation tool control system (320 of FIG. 3), the axial oscillation tool (e.g., 120 of FIG. 1A or 1B) to generate an initial axial pressure pulse or series of axial pressure pulses having an initial amplitude and frequency down the drill string system (e.g., 108 of FIG. 1A or 1B). The initial amplitude and frequency may be based on last known values, simulated values, modeled values, heuristic values, or user input. In certain embodiments, the initial amplitude may be in a range between 50 and 2000 psi and the initial frequency may be in a range between 0.5 and 30 Hz. One of ordinary skill in the art will recognize that the above-noted ranges may vary based on an application or design. In step 920, the optimizing control system (1200 of FIG. 3) may optionally measure a first output response corresponding to oscillation of the drill string system (e.g., 108 of FIG. 1A or 1B). In step 930, the optimizing control system (1200 of FIG. 3) may determine a dominant or resonant frequency of the output response, using any one or more of the methods previously disclosed herein.

In certain embodiments, the dominant or resonant frequency may be determined using frequency optimization and the Fast Fourier Transform. The optimizing control system (1200 of FIG. 3) may receive raw sensor data from a sensor (e.g., 330 of FIG. 3), such as, for example, an accelerometer disposed on or near the axial oscillation tool (e.g., 120 of FIG. 1A or 1B). The raw sensor data may include time-domain sensor output data for the sensor (e.g., 330 of FIG. 3) as a proxy for the drill string (e.g., 108 of FIG. 1A or 1B) itself. The time-domain sensor output data may include axial acceleration data as a function of time when the sensor is an accelerometer. In other embodiments, where the sensor senses axial displacement, the time-domain sensor output data may include time-domain axial displacement data (not shown) as a function of time. In still other embodiments, where the sensor senses pressure, the time-domain sensor output data may include time-domain pressure data (not shown) as a function of time. The optimizing control system (1200 of FIG. 3) may perform a Fast Fourier Transform of the raw sensor data to obtain frequency-domain sensor output data. The frequency-domain acceleration data may include axial acceleration as a function of frequency when the sensor is an accelerometer, thereby graphically exposing the dominant or resonant frequency. In such a case, the dominant or resonant frequency may be determined from the frequency-domain sensor output data by determining the frequency at which acceleration as a function of frequency has a maximum value. In other embodiments, the frequency-domain sensor output data may include axial displacement data as a function of frequency when the sensor is an axial displacement sensor. In still other embodiments, the frequency-domain sensor output data may include pressure data as a function of frequency when the sensor is a pressure sensor. In other embodiments, the dominant or resonant frequency may be determined using the logarithmic decrement. The optimizing control system (1200 of FIG. 3) may receive raw sensor data from a sensor (e.g., 330 of FIG. 3), such as, for example, an accelerometer disposed on or near the axial oscillation tool (e.g., 120 of FIG. 1A or 1B). The raw sensor data may include time-domain sensor output data for the sensor (e.g., 330 of FIG. 3) as a proxy for the drill string (e.g., 108 of FIG. 1A or 1B) itself. The successive first, $A_1$, and second $A_2$, amplitude peaks may be determined from the time-domain sensor output data. A logarithmic decrement, $\delta$, representing the rate at which the amplitude of a free damped vibration decreases, may be calculated by the optimizing control system (1200 of FIG. 3) as the natural logarithm of the ratio of the second amplitude peak to the first amplitude peak. A damping ratio, $\zeta$, may be calculated by the optimizing control system (1200 of FIG. 3) based on the logarithmic decrement, $\delta$, representing the ratio of actual damping to critical damping, where the damping ratio, $\zeta$, is calculated by dividing the logarithmic decrement, $\delta$, by the square root of the sum of $4\pi^2$ plus the square of the logarithmic decrement, $\delta$. If the damping ratio, $\zeta$ is in the range, $0<\zeta<1$, then the system may be said to be underdamped and subject to oscillating. The period, T, between the successive first and second amplitude peaks may be determined. As such, the damped angular frequency, $\omega_D$, may be calculated by dividing $2\pi$ by the period T providing a damped angular frequency in radians per second. The optimizing control system (1200 of FIG. 3) may calculate a dominant or resonant frequency from the calculated damped angular frequency, $\omega_D$, by converting radians per second to Hz.

In still other embodiments, the dominant or resonant frequency may be determined using a swept sinusoid. The optimizing control system (1200 of FIG. 3) may command, directly or indirectly, the axial oscillation tool (e.g., 120 of FIG. 1A or 1B) to generate an axial pressure pulse or series of axial pressure pulses corresponding to a swept sinusoid having the initial amplitude, initial frequency, and a frequency step size that may vary from cycle to cycle. The optimizing control system (1200 of FIG. 3) may measure an output response corresponding to oscillation of the drill string (e.g., 108 of FIG. 1A or 1B) and may determine a measured amplitude of the output response at each frequency step. Then, the optimizing control system (1200 of FIG. 3) may calculate a ratio of measured amplitude to initial amplitude at each frequency step constituting an unparameterized data set. Using well known mathematical techniques, the data set may be parameterized to generate a transmissibility curve function. The optimizing control system (1200 of FIG. 3) may determine a dominant or resonant frequency from the transmissibility curve function, where the dominant or resonant frequency may correspond to a maximum value for normalized acceleration on the transmissibility curve.

One of ordinary skill in the art will recognize that the dominant or resonant frequency may be conditional because it depends on many factors and may change dynamically during drilling operations. As such, step 920 may be repeated periodically to determine the dominant or resonant frequency for the current environment.

Figure 9B:
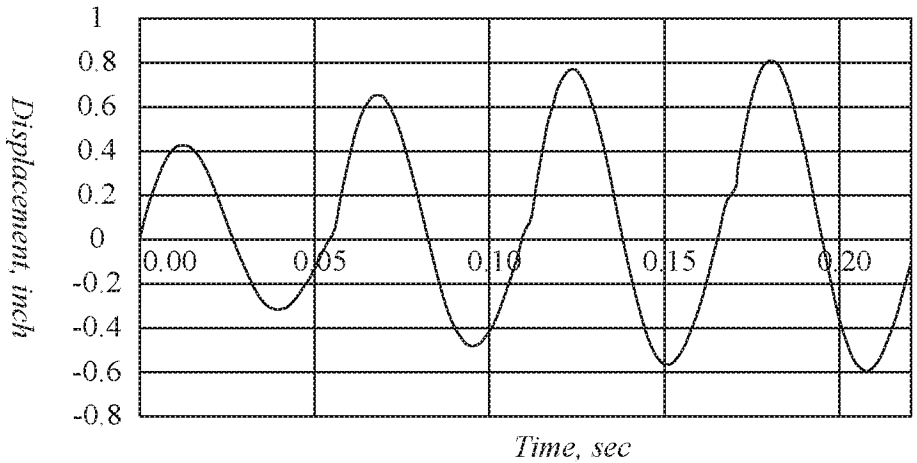
FIG. 9B shows pulsing with the dominant or resonant frequency to increase the amplitude of oscillations and the rate of penetration in accordance with one or more embodiments of the present invention.

Upon determination of the dominant or resonant frequency, the optimizing control system (1200 of FIG. 3) may command, directly or indirectly, the axial oscillation tool (e.g., 120 of FIG. 1A or 1B) to change the initial frequency to the dominant or resonant frequency determined in step 920. As shown in FIG. 9B, pulsing with the resonant frequency increases the amplitude of oscillations and, consequently, increases ROP. This in turn reduces the power consumed by the axial oscillation tool. Conventional axial oscillation tools typically consume between 300 psi to 600 psi of the available pressure rating of the drilling rig. This translates to several hundred horsepower of the rig power budget. By maintaining the desired oscillation with lower power consumption, significant savings may be recognized or alternatively may be provided to other hydraulically powered equipment such as the mud motor or drill bit, further increasing the ROP and efficiency of the drilling operation. At this point, having determined the conditionally optimal frequency, focus can shift to identifying the optimal amplitude. Steps 940 through 970 may be repeated to identify the optimal amplitude from candidates to select the optimal amplitude that maximizes downhole velocity.

Figure 11:
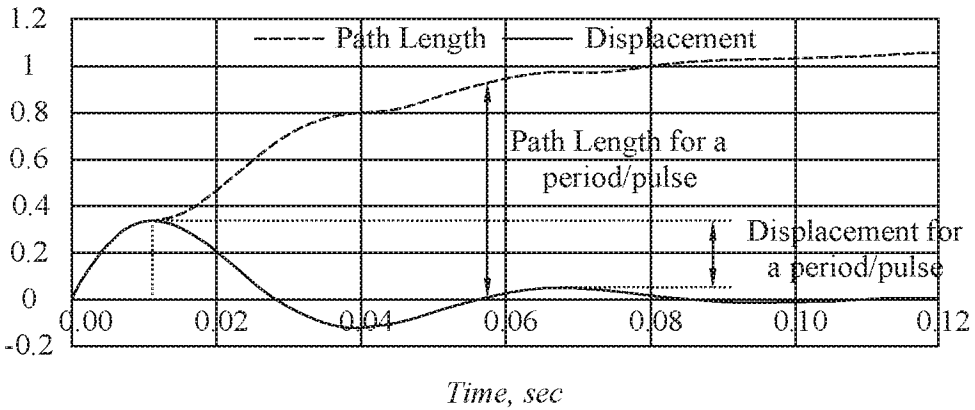
FIG. 11 shows a path length and displacement in accordance with one or more embodiments of the present invention.

In step 940, a downhole velocity may be determined for the initial amplitude and repeated as discussed herein. In step 942, the optimizing control system (1200 of FIG. 3) may set an initial position and initial velocity for further integration. The initial values for position, so, may be set to zero as we are interested in relative displacement for a period or pulse as shown in FIG. 11. Some value of initial velocity, $v_0$, may be chosen for the purpose of performing the calculations, but the linear tendency should be removed from the calculated displacement. One of ordinary skill in the art will appreciate that other considerations reflecting current conditions may be utilized in this manner. While there are various methods for calculating the displacement from measured acceleration, in step 944, the accelerometer output signal may be subjected to single or double integration to determine either velocity or displacement respectively:

$$s(t)=s_0+v_0t+\int_0^T(\int_0^T a(t)dt)dt \tag{4}$$

where s(t) is the displacement at time t, a(t) is the acceleration at time t, $s_0$ is the initial position, $v_0$ is the initial velocity, and T is the period of oscillation. In step 946, the optimizing control system (1200 of FIG. 3) may calculate a downhole velocity as the displacement per period, where:

$$\text{Downhole velocity} = \frac{\text{Displacement per period}}{\text{Period}} = \text{Displacement per period} \times \text{Frequency}. \tag{6}$$

In step 950, the optimizing control system (1200 of FIG. 3) may receive as input or otherwise use historical data, models, or simulations to determine an increment size for amplitude in view of the practical limits of the system and diminishing returns. The practical limits for increasing the amplitude may be based on a trade-off between tool reliability and survivability, the increased hydraulic power required by the axial oscillation tool versus the potential for that power to be used beneficially by other components, or the practical limit of diminishing returns whereby the increase in amplitude produces minimal increases in performance.

In step 960, the optimizing control system (1200 of FIG. 3) may perform an amplitude test to determine the optimal amplitude by calculating a downhole velocity for the initial amplitude, the initial amplitude plus the increment, and the initial amplitude less the increment. The amplitude that maximizes downhole velocity may be selected as the optimal amplitude for further use. For example, the optimizing control system (1200 of FIG. 3) may command the axial oscillation tool to increment the initial amplitude by the increment size. The optimizing control system (1200 of FIG. 3) may receive raw sensor data from the sensor (e.g., 330 of FIG. 3) disposed on or near the axial oscillation tool, where the raw sensor data includes time-domain acceleration data when the sensor (e.g., 330 of FIG. 3) is an accelerometer. In other embodiments, the raw sensor data may include time-domain axial displacement data when the sensor (e.g., 330 of FIG. 3) is a displacement sensor. In still other embodiments, the raw sensor data may include time-domain pressure data when the sensor (e.g., 330 of FIG. 3) is a pressure sensor. The optimizing control system (1200 of FIG. 3) may determine a downhole velocity for the initial amplitude plus increment as set out in step 940. Similarly, the optimizing control system (1200 of FIG. 3) may command the axial oscillation tool to decrement the initial amplitude by the increment size. The optimizing control system (1200 of FIG. 3) may receive raw sensor data from a sensor (e.g., 330 of FIG. 3), such as, for example, an accelerometer disposed on or near the axial oscillation tool, where the raw sensor data includes time-domain acceleration data when the sensor (e.g., 330 of FIG. 3) is an accelerometer. The optimizing control system (1200 of FIG. 3) may determine a downhole velocity for the initial amplitude less the increment as set out in step 940. From among these three amplitude candidates, the optimizing control system (1200 of FIG. 3) may select the amplitude that maximizes downhole velocity as the optimal amplitude for further use. However, one of ordinary skill in the art will recognize that any number of amplitudes may potentially be evaluated in accordance with one or more embodiments of the present invention.

In step 970, the optimizing control system (1200 of FIG. 3) may command, directly or indirectly, the axial oscillation tool (e.g., 120 of FIG. 1A or 1B) to change the initial amplitude to the optimal amplitude determined in step 960. Thus, the downhole velocity method may use any of the prior methods to determine a conditionally optimal frequency, which may be revisited from time to time and optimizes the amplitude by selecting an amplitude from one or more candidates varied by an increment, to select the amplitude that maximizes downhole velocity.

Figure 10:
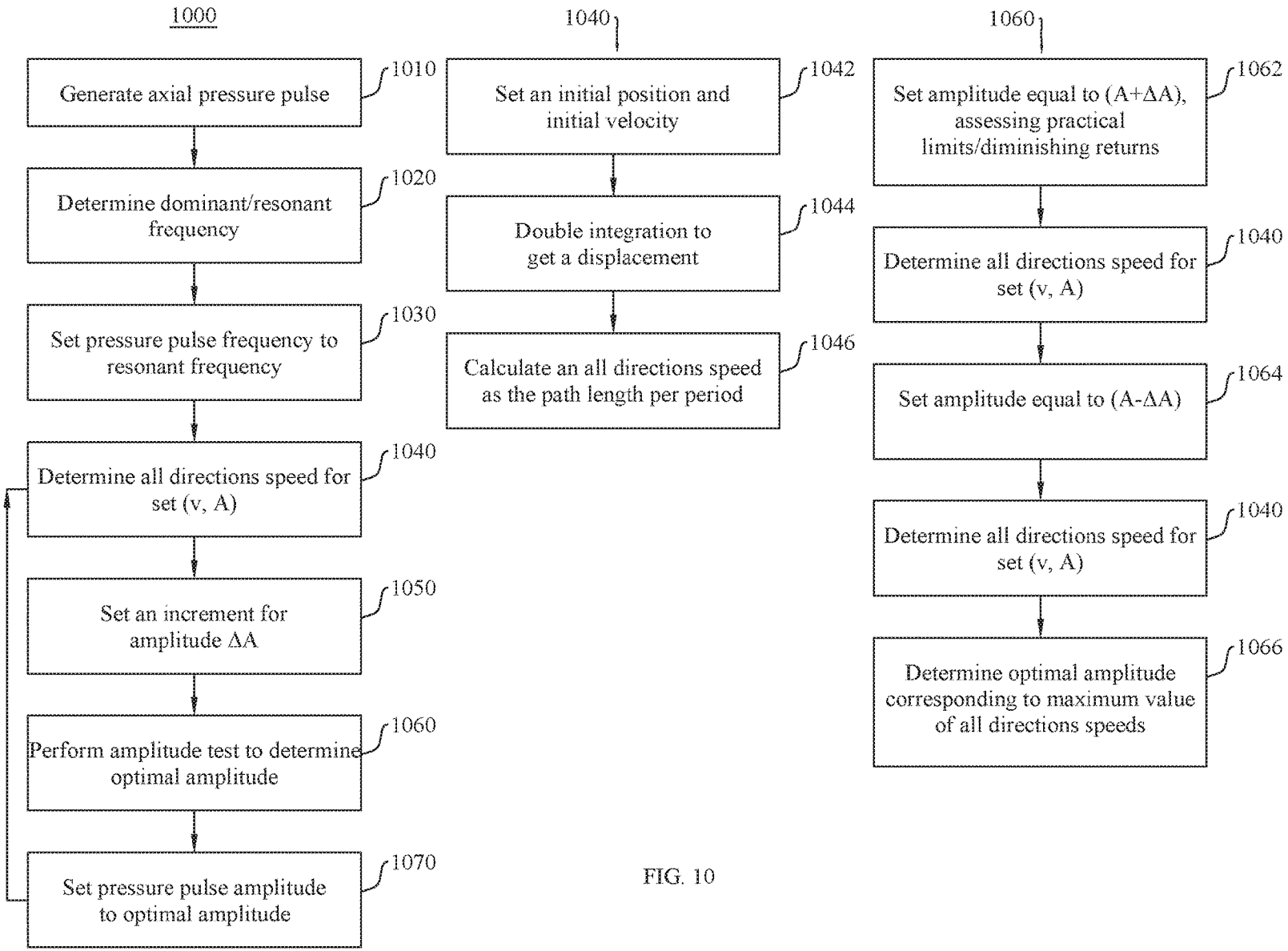
FIG. 10 shows a speed method of downhole pulse generation in accordance with one or more embodiments of the present invention.

In one or more embodiments of the present invention, the path length per period, where the path length is the total distance traveled by the sensor as proxy for the axial oscillation tool and drill string, may be used to determine a conditional dominant or resonant frequency and optimal amplitude. FIG. 10 shows a speed method of downhole pulse generation 1000 in accordance with one or more embodiments of the present invention.

In step 1010, the axial oscillation tool control system (320 of FIG. 3) may command, or the optimizing control system (1200 of FIG. 3) may command, directly or indirectly via the axial oscillation tool control system (320 of FIG. 3), the axial oscillation tool (e.g., 120 of FIG. 1A or 1B) to generate an initial axial pressure pulse or series of axial pressure pulses having an initial amplitude and frequency down the drill string system (e.g., 108 of FIG. 1A or 1B). In step 1020, the optimizing control system (1200 of FIG. 3) may optionally measure a first output response corresponding to oscillation of the drill string system (e.g., 108 of FIG. 1A or 1B). In step 1030, the optimizing control system (1200 of FIG. 3) may determine a dominant or resonant frequency of the output response, using any one or more of the methods previously disclosed herein.

In certain embodiments, the dominant or resonant frequency may be determined using frequency optimization and the Fast Fourier Transform. The optimizing control system (1200 of FIG. 3) may receive raw sensor data from a sensor (e.g., 330 of FIG. 3), such as, for example, an accelerometer disposed on or near the axial oscillation tool (e.g., 120 of FIG. 1A or 1B). The raw sensor data may include time-domain sensor output data for the sensor as a proxy for the drill string (e.g., 108 of FIG. 1A or 1B) itself. The time-domain sensor output data may include axial acceleration data as a function of time when the sensor (e.g., 330 of FIG. 3) is an accelerometer. In other embodiments, where the sensor senses axial displacement, the time-domain sensor output data may include axial displacement data (not shown) as a function of time. In still other embodiments, where the sensor senses pressure, the time-domain sensor output data may include pressure data (not shown) as a function of time. The optimizing control system (1200 of FIG. 3) may perform a Fast Fourier Transform of the raw sensor data to obtain frequency-domain sensor output data. The frequency-domain sensor output data may include axial acceleration as a function of frequency when the sensor (e.g., 330 of FIG. 3) is an accelerometer, thereby graphically exposing the dominant or resonant frequency. The dominant or resonant frequency may be determined from the frequency-domain acceleration data by determining the frequency at which acceleration as a function of frequency has a maximum value.

In other embodiments, the dominant or resonant frequency may be determined using the logarithmic decrement. The optimizing control system (1200 of FIG. 3) may receive raw sensor data from a sensor (e.g., 330 of FIG. 3), such as, for example, an accelerometer disposed on or near the axial oscillation tool (e.g., 120 of FIG. 1A or 1B). The raw sensor data may include time-domain sensor output data for the sensor (e.g., 330 of FIG. 3) as a proxy for the drill string (e.g., 108 of FIG. 1A or 1B) itself. The successive first, $A_1$, and second $A_2$, amplitude peaks may be determined from the time-domain sensor output data, which in this example is time-domain acceleration data. A logarithmic decrement, $\delta$, representing the rate at which the amplitude of a free damped vibration decreases, may be calculated by the optimizing control system (1200 of FIG. 3) as the natural logarithm of the ratio of the second amplitude peak to the first amplitude peak. A damping ratio, $\zeta$, may be calculated by the optimizing control system (1200 of FIG. 3) based on the logarithmic decrement, $\delta$, representing the ratio of actual damping to critical damping, where the damping ratio, $\zeta$, is calculated by dividing the logarithmic decrement, $\delta$, by the square root of the sum of $4\pi^2$ plus the square of the logarithmic decrement, $\delta$. If the damping ratio, $\zeta$ is in the range, $0<\zeta<1$, then the system may be said to be underdamped and subject to oscillating. The period, T, between the successive first and second amplitude peaks may be determined. As such, the damped angular frequency, $\omega_D$, may be calculated by dividing a $2\pi$ by the period T providing a damped angular frequency in radians per second. The optimizing control system (1200 of FIG. 3) may calculate a dominant or resonant frequency from the calculated damped angular frequency, $\omega_D$, by converting radians per second to Hz.

In still other embodiments, the dominant or resonant frequency may be determined using swept sinusoid. The optimizing control system (1200 of FIG. 3) may command, directly or indirectly, the axial oscillation tool (e.g., 120 of FIG. 1A or 1B) to generate an axial pressure pulse or series of axial pressure pulses corresponding to a swept sinusoid having the initial amplitude, initial frequency, and a frequency step size that may vary from cycle to cycle. The optimizing control system (1200 of FIG. 3) may measure an output response corresponding to oscillation of the drill string system (e.g., 108 of FIG. 1A or 1B) and may determine a measured amplitude of the output response at each frequency step. Then, the optimizing control system (1200 of FIG. 3) may calculate a ratio of measured amplitude to initial amplitude at each frequency step constituting an unparameterized data set. Using well known mathematical techniques, the data set may be parameterized to generate a transmissibility curve function. The optimizing control system (1200 of FIG. 3) may determine a dominant or resonant frequency from the transmissibility curve function, where the dominant or resonant frequency may correspond to a maximum value for normalized acceleration on the transmissibility curve.

One of ordinary skill in the art will recognize that the dominant or resonant frequency is likely conditional because it depends on many factors and may change dynamically during drilling operations. As such, step 1020 may be repeated periodically to determine the dominant or resonant frequency for the current environment.

Upon determination of the dominant or resonant frequency, the optimizing control system (1200 of FIG. 3) may command, directly or indirectly, the axial oscillation tool (e.g., 120 of FIG. 1A or 1B) to change the initial frequency to the dominant or resonant frequency determined in step 1020. Pulsing with the resonant frequency increases the amplitude of oscillations and, consequently, increases the ROP. This is turn reduces the power consumed by the axial oscillation tool. Conventional axial oscillation tools typically use 300 psi to 600 psi of the available pressure rating of the drilling rig. This translates to several hundred horsepower of the rig power budget. By maintaining the desired oscillation with lower power consumption, significant savings may be recognized or alternatively may be provided to other hydraulically powered equipment such as the mud motor or drill bit, further increasing the ROP and efficiency of the drilling operation. At this point, having determined the conditionally optimal frequency, focus can shift to identifying the optimal amplitude. Steps 1040 through 1070 may be repeated to identify the optimal amplitude from candidates to select the optimal amplitude that maximizes all directions speed.

In step 1040, the optimizing control system (1200 of FIG. 3) may determine an all directions speed. In step 1042, the optimizing control system (1200 of FIG. 3) may set an initial position and initial velocity for further integration. The initial values for position, so, may be set to zero as we are primarily interested in relative displacement. Some value of initial velocity, $v_0$, may be chosen for the purpose of performing the calculations, but the linear tendency should be removed from the calculated displacement. One of ordinary skill in the art will appreciate that other considerations reflecting current conditions may be utilized in this manner. While there are various methods for calculating the displacement from measured acceleration, in step 1044, the accelerometer output signal may be subjected to single or double integration to determine either velocity or displacement respectively:

$$s(t)=s_0+v_0t+\int_0^t(f_0^t a(t)dt)dt \tag{6}$$

where s(t) is the displacement at time t, a(t) is the acceleration at time t, $s_0$ is the initial position, $v_0$ is the initial velocity, and T is the period of oscillation. In step 1046, the optimizing control system (1200 of FIG. 3) may calculate an all directions speed, based on a path length per period, as shown in FIG. 11, where:

$$\text{All directions speed} = \frac{\text{Path length per period}}{\text{Period}} = \text{Path length per period} \times \text{Frequency}. \quad (7)$$

In step 1050, the optimizing control system (1200 of FIG. 3) may receive as input or otherwise use historical data, models, or simulations to determine an increment size for amplitude in view of the practical limits of the system and diminishing returns. The practical limits for increasing the amplitude may be based on a trade-off between tool reliability and survivability, the increased hydraulic power required by the axial oscillation tool versus the potential for that power to be used beneficially by other components, or the practical limit of diminishing returns whereby the increase in amplitude produces minimal increases in performance.

In step 1060, the optimizing control system (1200 of FIG. 3) may perform an amplitude test to determine the optimal amplitude by calculating an all directions speed for the initial amplitude, the initial amplitude plus the increment, and the initial amplitude less the increment. The amplitude that maximizes all directions speed may be selected as the optimal amplitude for further use. For example, the optimizing control system (1200 of FIG. 3) may command the axial oscillation tool to increment the initial amplitude by the increment size. The optimizing control system (1200 of FIG. 3) may receive raw sensor data from a sensor (e.g., 330 of FIG. 3), such as, for example, an accelerometer disposed on or near the axial oscillation tool, where the raw sensor data includes time-domain sensor output data. The optimizing control system (1200 of FIG. 3) may determine an all directions speed for the initial amplitude plus increment as set out in step 1040. Similarly, the optimizing control system (1200 of FIG. 3) may command the axial oscillation tool to decrement the initial amplitude by the increment size. The optimizing control system (1200 of FIG. 3) may receive raw sensor data from a sensor (e.g., 330 of FIG. 3), such as, for example, an accelerometer disposed on or near the axial oscillation tool. The raw sensor data includes time-domain sensor output data, or time domain acceleration data when the sensor (e.g., 330 of FIG. 3) is an accelerometer. One of ordinary skill in the art having the benefit of this disclosure will recognize that in other embodiments, time-domain sensor output data may comprise time-domain axial displacement data or time-domain pressure data. The optimizing control system (1200 of FIG. 3) may determine an all directions speed for the initial amplitude less the increment as set out in step 1040. From among these three amplitude candidates, the optimizing control system (1200 of FIG. 3) may select the amplitude that maximizes the all directions speed as the optimal amplitude for further use. However, one of ordinary skill in the art will recognize that any number of amplitudes may potentially be evaluated in accordance with one or more embodiments of the present invention.

Figure 12:
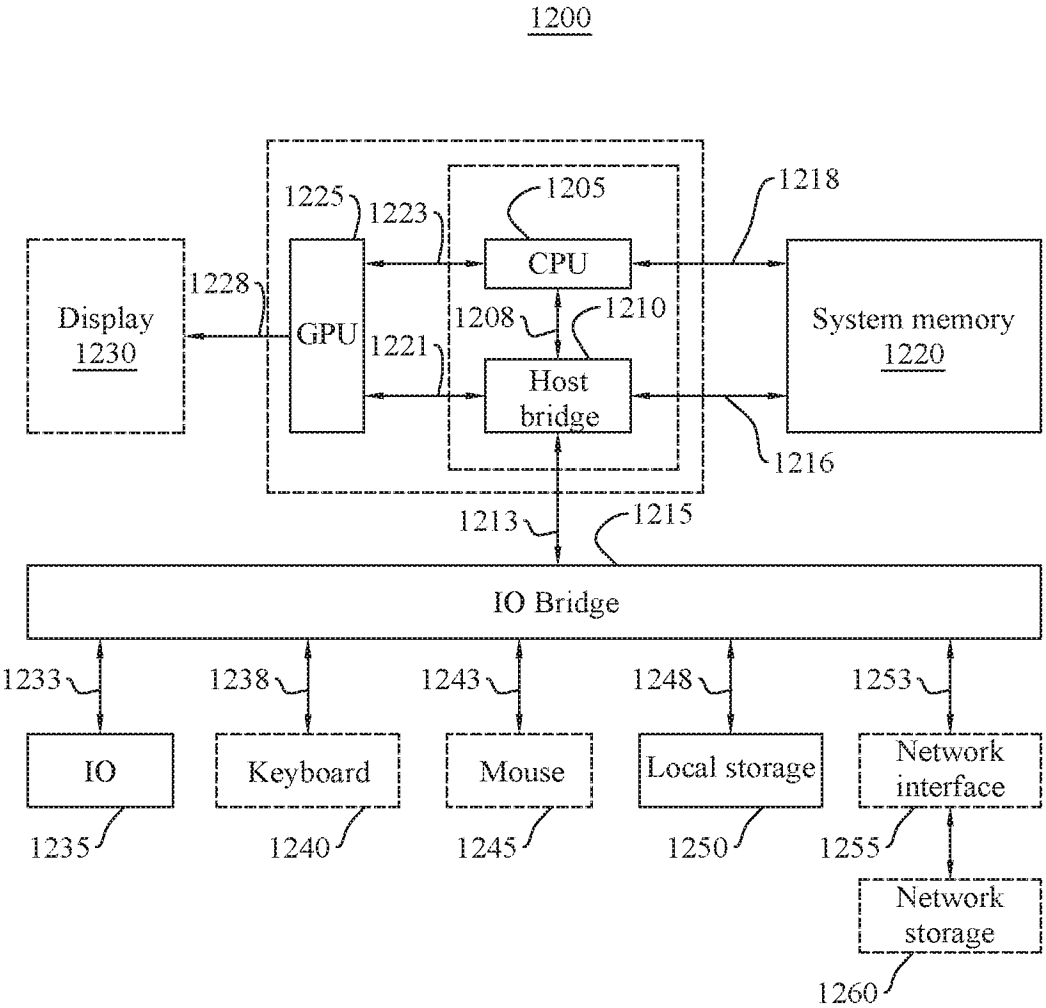
FIG. 12 shows an exemplary optimizing control system in accordance with one or more embodiments of the present invention.

FIG. 12 shows an exemplary optimizing control system 1200 in accordance with one or more embodiments of the present invention. Because optimizing control system 1200 is disposed downhole, the components and the functions that they implement may vary based on an application or design. As such, one of ordinary skill in the art, having the benefit of this disclosure, will appreciate that a subset, superset, or combination of functions or features, may be integrated, distributed, or excluded, in whole or in part, based on an application, design, or form factor in accordance with one or more embodiments of the present invention. As such, the description of system 1200 is merely exemplary and not intended to limit the type, kind, or configuration of component devices that constitute an optimizing control system 1200 suitable for performing a method of downhole pulse generation in accordance with one or more embodiments of the present invention.

An exemplary computer or control system 1200 may include one or more of Central Processing Unit ("CPU") 1205, host bridge 1210, Input/Output ("IO") bridge 1215, Graphics Processing Unit ("GPUs") 1225, Application-Specific Integrated Circuit ("ASIC") (not shown), and Programmable Logic Controller ("PLC") (not shown) disposed on one or more printed circuit boards (not shown) that perform computational or logical operations. Each computational device may be a single-core device or a multi-core device. Multi-core devices typically include a plurality of cores (not shown) disposed on the same physical die (not shown) or a plurality of cores (not shown) disposed on multiple die (not shown) that are collectively disposed within the same mechanical package (not shown).

CPU 1205 may be a general-purpose computational device that executes software instructions. CPU 1205 may include one or more of interface 1208 to host bridge 1210, interface 1218 to system memory 1220, and interface 1223 to one or more IO devices, such as, for example, one or more optional GPUs 1225. GPU 1225 may serve as a specialized computational device that typically performs graphics functions related to frame buffer manipulation. However, one of ordinary skill in the art will recognize that GPU 1225 may be used to perform non-graphics related functions that are computationally intensive. In certain embodiments, GPU 1225 may interface 1223 directly with CPU 1205 (and indirectly interface 1218 with system memory 1220 through CPU 1205). In other embodiments, GPU 1225 may interface 1221 directly with host bridge 1210 (and indirectly interface 1216 or 1218 with system memory 1220 through host bridge 1210 or CPU 1205 depending on the application or design). In still other embodiments, GPU 1225 may directly interface 1233 with IO bridge 1215 (and indirectly interface 1216 or 1218 with system memory 1220 through host bridge 1210 or CPU 1205 depending on the application or design). One of ordinary skill in the art will recognize that GPU 1225 includes on-board memory as well. In certain embodiments, the functionality of GPU 1225 may be integrated, in whole or in part, with CPU 1205 and/or host bridge 1210, if included at all.

Host bridge 1210 may be an interface device that interfaces between the one or more computational devices and IO bridge 1215 and, in some embodiments, system memory 1220. Host bridge 1210 may include interface 1208 to CPU 1205, interface 1213 to IO bridge 1215, for embodiments where CPU 1205 does not include interface 1218 to system memory 1220, interface 1216 to system memory 320, and for embodiments where CPU 1205 does not include an integrated GPU 1225 or interface 1223 to GPU 1225, interface 1221 to GPU 1225. The functionality of host bridge 1210 may be integrated, in whole or in part, with CPU 1205 and/or GPU 1225.

IO bridge 1215 may be an interface device that interfaces between the one or more computational devices and various IO devices (e.g., 1240, 1245) and IO expansion, or add-on, devices (not independently illustrated). IO bridge 1215 may include interface 1213 to host bridge 1210, one or more interfaces 1233 to one or more IO expansion devices 1235, interface 1238 to optional keyboard 1240, interface 1243 to optional mouse 1245, interface 1248 to one or more local storage devices 1250, and interface 1253 to one or more optional network interface devices 1255. The functionality of IO bridge 1215 may be integrated, in whole or in part, with CPU 1205, host bridge 1210, and/or GPU 1225. Each local storage device 1250, if any, may be a solid-state memory device, a solid-state memory device array, a hard disk drive, a hard disk drive array, or any other non-transitory computer readable medium. An optional network interface device 1255 may provide one or more network interfaces including any network protocol suitable to facilitate networked communications.

Control system 1200 may include one or more optional network-attached storage devices 1260 in addition to, or instead of, one or more local storage devices 1250. Each network-attached storage device 1260, if any, may be a solid-state memory device, a solid-state memory device array, a hard disk drive, a hard disk drive array, or any other non-transitory computer readable medium. Network-attached storage device 1260 may or may not be collocated with control system 1200 and may be accessible to control system 1200 via one or more network interfaces provided by one or more network interface devices 1255.

One of ordinary skill in the art will recognize that control system 1200 may be a conventional computing system or an application-specific computing system (not shown) configured for industrial applications. In certain embodiments, an application-specific computing system (not shown) may include one or more ASICs (not shown) PLCs (not shown) that perform one or more specialized functions in a more efficient manner. The one or more ASICs (not shown) may interface directly with CPU 1205, host bridge 1210, or GPU 1225 or interface through IO bridge 1215. Alternatively, in other embodiments, an application-specific computing system (not shown) may represent a reduced number of components that are necessary to perform a desired function or functions in an effort to reduce one or more of chip count, printed circuit board footprint, thermal design power, and power consumption. In such embodiments, the one or more ASICs (not shown) and/or PLCs (not shown) may be used instead of one or more of CPU 1205, host bridge 1210, IO bridge 1215, or GPU 1225, and may execute software instructions. In such systems, the one or more ASICs (not shown) or PLCs (not shown) may incorporate sufficient functionality to perform certain network, computational, or logical functions in a minimal footprint with substantially fewer component devices.

As such, one of ordinary skill in the art will recognize that CPU 1205, host bridge 1210, IO bridge 1215, GPU 1225, ASIC (not shown), or PLC (not shown) or a subset, superset, or combination of functions or features thereof, may be integrated, distributed, or excluded, in whole or in part, based on an application, design, or form factor in accordance with one or more embodiments of the present invention. Thus, the description of control system 1200 is merely exemplary and not intended to limit the type, kind, or configuration of component devices that constitute an optimizing control system 1200 suitable for performing computing operations in accordance with one or more embodiments of the present invention. Notwithstanding the above, one of ordinary skill in the art will recognize that control system 1200 may be a downhole system that may vary based on an application or design.

In one or more embodiments of the present invention, a method of downhole pulse generation comprises commanding the axial oscillation tool to generate an axial pressure pulse or series of axial pressure pulses corresponding to a swept sinusoid having an initial amplitude, initial frequency, and frequency step size, measuring an output response corresponding to oscillation of the drill string system, determining a measured amplitude of the output response at each frequency step, calculating a ratio of measured amplitude to an initial amplitude at each frequency step constituting an unparameterized data set, parameterizing the data set to generate a transmissibility curve function, determining a dominant frequency from the transmissibility curve function, and commanding the axial oscillation tool to change the predetermined frequency to the dominant frequency. Commanding the axial oscillation tool comprises commanding the axial oscillation tool directly or indirectly via an axial oscillation control system.

In one or more embodiments of the present invention, a method of downhole pulse generation comprises commanding an axial oscillation tool to generate an initial axial pressure pulse or series of axial pressure pulses having a predetermined amplitude and frequency down a drill string system, receiving raw sensor data from a sensor disposed on or near the axial oscillation tool, the raw sensor data comprising time-domain sensor output data, performing a Fast Fourier Transform of the raw sensor data to obtain frequency-domain sensor output data, determining a dominant frequency from the frequency-domain sensor output data, and commanding the axial oscillation tool to change the predetermined frequency to the dominant frequency. Commanding the axial oscillation tool comprises commanding the axial oscillation tool directly or indirectly via an axial oscillation tool control system. In certain embodiments, the time-domain sensor output data comprises axial acceleration, axial displacement, or axial acceleration and axial displacement as a function of time. In certain embodiments, the frequency-domain sensor output data comprises axial acceleration, axial displacement, or axial acceleration and axial displacement as a function of frequency. The dominant frequency corresponds to a frequency at which acceleration, axial displacement, or axial acceleration and axial displacement as a function of frequency has a maximum value.

In one or more embodiments of the present invention, a method of downhole pulse generation includes commanding an axial oscillation tool to generate an axial pressure pulse or a series of axial pressure pulses having an initial amplitude and frequency down a drill string system, measuring an output response corresponding to oscillation of the drill string system, determining a dominant frequency of the output response, commanding the axial oscillation tool to change the initial frequency to the dominant frequency, determining a downhole velocity for the initial amplitude, determining an optimal amplitude that maximizes downhole velocity, and commanding the axial oscillation tool to change the initial amplitude to the optimal amplitude. Determining the dominant frequency may include receiving raw sensor data from a sensor disposed on or near the axial oscillation tool, the raw sensor data comprising time-domain sensor output data, performing a Fast Fourier Transform of the raw sensor data to obtain frequency-domain sensor output data, and determining the dominant frequency from the frequency-domain sensor output data. Commanding the axial oscillation tool to generate the axial pressure pulse or the series of axial pressure pulses may include commanding the axial oscillation tool to generate the axial pressure pulse or the series of axial pressure pulses comprises commanding the axial oscillation tool to generate the axial pressure pulse or the series of axial pressure pulses corresponding to a swept sinusoid having the initial amplitude and a frequency step size. Determining the dominant frequency comprises determining a measured amplitude of the output response at each frequency step, calculating a ratio of measured amplitude to an initial amplitude at each frequency step constituting an unparameterized data set, parameterizing the data set to generate a maximum output frequency curve, and determining the dominant frequency from the maximum output frequency curve.

Determining the downhole velocity may include setting an initial position and velocity for downhole, calculating a displacement as a function of time based on the initial position, velocity, and period of oscillation of the drill string system, and calculating the downhole velocity based on the displacement per period. Calculating the displacement as a function of time may include double integration of acceleration as a function of time over a single period. Determining the optimal amplitude comprises commanding the axial oscillation tool to increment the initial amplitude by a predetermined amount, receiving raw sensor data from the sensor disposed on or near the axial oscillation tool, the raw sensor data comprising time-domain sensor output data, determining a second downhole velocity for the initial amplitude plus the predetermined increment, commanding the axial oscillation tool to decrement the initial amplitude by the predetermined amount, receiving raw sensor data from the sensor disposed on or near the axial oscillation tool, the raw sensor data comprising time-domain sensor output data, determining a third downhole velocity for the initial amplitude minus the predetermined increment, determining a maximum downhole velocity from the initial, second, and third downhole velocities, and determining the optimal amplitude corresponding to the maximum downhole velocity.

In one or more embodiments of the present invention, method of downhole pulse generation includes commanding an axial oscillation tool to generate an initial axial pressure pulse or a series of axial pressure pulses having an initial amplitude and frequency down a drill string system, determining a dominant frequency of an output response corresponding to oscillation of the drill string system, commanding the axial oscillation tool to change the initial frequency to the dominant frequency, determining an all directions speed for the initial amplitude, determining an optimal amplitude that maximizes the all directions speed, and commanding the axial oscillation tool to change the initial amplitude to the optimal amplitude. Determining the dominant frequency may include receiving raw sensor data from a sensor disposed on or near the axial oscillation tool, the raw sensor data comprising time-domain sensor output data, performing a Fast Fourier Transform of the raw sensor data to obtain frequency-domain sensor output data, and determining the dominant frequency from the frequency-domain sensor data. Commanding the axial oscillation tool to generate the axial pressure pulse or the series of axial pressure pulses may include commanding the axial oscillation tool to generate the axial pressure pulse or the series of axial pressure pulses corresponding to a swept sinusoid having the initial amplitude and a frequency step size. Determining the dominant frequency may include determining a measured amplitude of the output response at each frequency step, calculating a ratio of measured amplitude to an initial amplitude at each frequency step constituting an unparameterized data set, parameterizing the data set to generate a maximum output frequency curve, and determining the dominant frequency from the maximum output frequency curve. Determining the all direction speed may include setting an initial position and velocity for downhole, calculating a displacement as a function of time based on the initial position, velocity, and period of oscillation of the drill string, and Calculating the all directions speed based on the path length per period. calculating the displacement as a function of time may include double integration of acceleration as a function of time evaluated at specific time. Determining the optimal amplitude may include commanding the axial oscillation tool to increment the initial amplitude by a predetermined amount, receiving raw sensor data from the sensor disposed on or near the axial oscillation tool, the raw sensor data comprising time-domain sensor output data, determining a second all directions speed for the initial amplitude plus the predetermined increment, commanding the axial oscillation tool to decrement the initial amplitude by the predetermined amount, receiving raw sensor data from the sensor disposed on or near the axial oscillation tool, the raw sensor data comprising time-domain sensor output data, determining a third all directions speed for the initial amplitude minus the predetermined increment, determining a maximum downhole velocity from the initial, second, and third all directions speeds, and determining the optimal amplitude corresponding to the maximum all directions speed.

One of ordinary skill in the art, having the benefit of this disclosure, will recognize that non-transitory computer-readable medium may comprise software instructions that, when executed by a processor, may perform one or more of the above-noted methods.

Advantages of one or more embodiments of the present invention may include one or more of the following:

In one or more embodiments of the present invention, a method and system for downhole pulse generation determines an optimal frequency for axial pressure pulses generated by an axial oscillation tool.

In one or more embodiments of the present invention, a method and system for downhole pulse generation determines an optimal amplitude for axial pressure pulses generated by an axial oscillation tool.

In one or more embodiments of the present invention, a method and system for downhole pulse generation may use sensor data provided by one or more sensors disposed on or near the axial oscillation tool to determine an optimal set of parameters for operation of the axial oscillation tool going forward.

In one or more embodiments of the present invention, a method and system for downhole pulse generation determines optimal parameters for operation of the axial oscillation tool based on hydraulic conditions and frictional forces of the actual drilling environment.

In one or more embodiments of the present invention, a method and system for downhole pulse generation communicates optimal parameters for operation of the axial oscillation tool directly to the axial oscillation tool via an optimizing control system.

In one or more embodiments of the present invention, a method and system for downhole pulse generation communicates optimal parameters for operation of the axial oscillation tool indirectly from the optimizing control system to the axial oscillation tool control system that controls the operation of the axial oscillation tool.

In one or more embodiments of the present invention, a method and system for downhole pulse generation substantially reduces frictional forces thereby allowing operators to drill ahead.

In one or more embodiments of the present invention, a method and system for downhole pulse generation substantially increases ROP thereby increasing the efficiency of drilling operations.

In one or more embodiments of the present invention, a method and system for downhole pulse generation allows tightly budgeted power consumption to be intelligently allocated and managed by providing optimal parameters to the axial oscillation tool.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should only be limited by the appended claims.

What is claimed is:

1. A method of downhole pulse generation comprising:

commanding the axial oscillation tool to generate an axial pressure pulse or series of axial pressure pulses corresponding to a swept sinusoid having an initial amplitude, initial frequency, and frequency step size;

measuring an output response corresponding to oscillation of the drill string system;

determining a measured amplitude of the output response at each frequency step;

calculating a ratio of measured amplitude to an initial amplitude at each frequency step constituting an unparameterized data set;

parameterizing the data set to generate a transmissibility curve function;

determining a dominant frequency from the transmissibility curve function; and commanding the axial oscillation tool to change the predetermined frequency to the dominant frequency.

2. The method of claim 1, wherein commanding the axial oscillation tool comprises commanding the axial oscillation tool directly or indirectly via an axial oscillation control system.

3. A method of downhole pulse generation comprising:

commanding an axial oscillation tool to generate an initial axial pressure pulse or series of axial pressure pulses having a predetermined amplitude and frequency down a drill string system;

receiving raw sensor data from a sensor disposed on or near the axial oscillation tool, the raw sensor data comprising time-domain sensor output data;

performing a Fast Fourier Transform of the raw sensor data to obtain frequency-domain sensor output data;

determining a dominant frequency from the frequency-domain sensor output data; and commanding the axial oscillation tool to change the predetermined frequency to the dominant frequency.

4. The method of claim 3, wherein commanding the axial oscillation tool comprises commanding the axial oscillation tool directly or indirectly via an axial oscillation tool control system.

5. The method of claim 3, wherein the time-domain sensor output data comprises axial acceleration, axial displacement, or axial acceleration and axial displacement as a function of time.

6. The method of claim 3, wherein the frequency-domain sensor output data comprises axial acceleration, axial displacement, or axial acceleration and axial displacement as a function of frequency.

7. The method of claim 3, wherein the dominant frequency corresponds to a frequency at which acceleration, axial displacement, or axial acceleration and axial displacement as a function of frequency has a maximum value.

8. A method of downhole pulse generation comprising:

commanding an axial oscillation tool to generate an axial pressure pulse or a series of axial pressure pulses having an initial amplitude and frequency down a drill string system;

measuring an output response corresponding to oscillation of the drill string system;

determining a dominant frequency of the output response;

commanding the axial oscillation tool to change the initial frequency to the dominant frequency;

determining a downhole velocity for the initial amplitude;

determining an optimal amplitude that maximizes downhole velocity; and commanding the axial oscillation tool to change the initial amplitude to the optimal amplitude.

9. The method of claim 8, wherein determining the dominant frequency comprises:

receiving raw sensor data from a sensor disposed on or near the axial oscillation tool, the raw sensor data comprising time-domain sensor output data;

performing a Fast Fourier Transform of the raw sensor data to obtain frequency-domain sensor output data; and determining the dominant frequency from the frequency-domain sensor output data.

10. The method of claim 8, wherein commanding the axial oscillation tool to generate the axial pressure pulse or the series of axial pressure pulses comprises:

commanding the axial oscillation tool to generate the axial pressure pulse or the series of axial pressure pulses corresponding to a swept sinusoid having the initial amplitude and a frequency step size.

11. The method of claim 10, wherein determining the dominant frequency comprises:

determining a measured amplitude of the output response at each frequency step;

calculating a ratio of measured amplitude to an initial amplitude at each frequency step constituting an unparameterized data set;

parameterizing the data set to generate a maximum output frequency curve; and determining the dominant frequency from the maximum output frequency curve.

12. The method of claim 8, wherein determining the downhole velocity comprises:

setting an initial position and velocity for downhole;

calculating a displacement as a function of time based on the initial position, velocity, and period of oscillation of the drill string system; and calculating the downhole velocity based on the displacement per period.

13. The method of claim 12, wherein calculating the displacement as a function of time comprises:

double integration of acceleration as a function of time over a single period.

14. The method of claim 8, wherein determining the optimal amplitude comprises:

commanding the axial oscillation tool to increment the initial amplitude by a predetermined amount;

receiving raw sensor data from the sensor disposed on or near the axial oscillation tool, the raw sensor data comprising time-domain sensor output data;

determining a second downhole velocity for the initial amplitude plus the predetermined increment;

commanding the axial oscillation tool to decrement the initial amplitude by the predetermined amount;

receiving raw sensor data from the sensor disposed on or near the axial oscillation tool, the raw sensor data comprising time-domain sensor output data;

determining a third downhole velocity for the initial amplitude minus the predetermined increment;

determining a maximum downhole velocity from the initial, second, and third downhole velocities; and determining the optimal amplitude corresponding to the maximum downhole velocity.

15. A method of downhole pulse generation comprising:

commanding an axial oscillation tool to generate an initial axial pressure pulse or a series of axial pressure pulses having an initial amplitude and frequency down a drill string system;

determining a dominant frequency of an output response corresponding to oscillation of the drill string system;

commanding the axial oscillation tool to change the initial frequency to the dominant frequency;

determining an all directions speed for the initial amplitude;

determining an optimal amplitude that maximizes the all directions speed; and commanding the axial oscillation tool to change the initial amplitude to the optimal amplitude.

16. The method of claim 15, wherein determining the dominant frequency comprises:

receiving raw sensor data from a sensor disposed on or near the axial oscillation tool, the raw sensor data comprising time-domain sensor output data;

performing a Fast Fourier Transform of the raw sensor data to obtain frequency-domain sensor output data; and determining the dominant frequency from the frequency-domain sensor data.

17. The method of claim 15, wherein commanding the axial oscillation tool to generate the axial pressure pulse or the series of axial pressure pulses comprises:

commanding the axial oscillation tool to generate the axial pressure pulse or the series of axial pressure pulses corresponding to a swept sinusoid having the initial amplitude and a frequency step size.

18. The method of claim 17, wherein determining the dominant frequency comprises:

determining a measured amplitude of the output response at each frequency step;

calculating a ratio of measured amplitude to an initial amplitude at each frequency step constituting an unparameterized data set;

parameterizing the data set to generate a maximum output frequency curve; and determining the dominant frequency from the maximum output frequency curve.

19. The method of claim 15, wherein determining the all direction speed comprises:

setting an initial position and velocity for downhole;

calculating a displacement as a function of time based on the initial position, velocity, and period of oscillation of the drill string; and calculating the all directions speed based on the path length per period.

20. The method of claim 19, wherein calculating the displacement as a function of time comprises:

double integration of acceleration as a function of time evaluated at specific time.

21. The method of claim 15, wherein determining the optimal amplitude comprises:

commanding the axial oscillation tool to increment the initial amplitude by a predetermined amount;

receiving raw sensor data from the sensor disposed on or near the axial oscillation tool, the raw sensor data comprising time-domain sensor output data;

determining a second all directions speed for the initial amplitude plus the predetermined increment;

commanding the axial oscillation tool to decrement the initial amplitude by the predetermined amount;

receiving raw sensor data from the sensor disposed on or near the axial oscillation tool, the raw sensor data comprising time-domain sensor output data;

determining a third all directions speed for the initial amplitude minus the predetermined increment;

determining a maximum downhole velocity from the initial, second, and third all directions speeds; and determining the optimal amplitude corresponding to the maximum all directions speed.

* * * * *